US005168313A

United States Patent [19]

Hosaka et al.

[11] Patent Number: 5,168,313

[45] Date of Patent: Dec. 1, 1992

[54] TONER IMAGE TRANSFER METHOD AND DEVICE FOR ELECTROPHOTOGRAPHIC PRINTING APPARATUS

[75] Inventors: Yasuo Hosaka, Tokyo; Tadayoshi Ohno, Kawasaki; Tsutomu Kanai, Yokohama, all of Japan

[73] Assignee: Kabushiki Kaisha Toshiba, Kawasaki, Japan

[21] Appl. No.: 343,621

[22] Filed: Apr. 27, 1989

[30] Foreign Application Priority Data

| | | | |
|---|---|---|---|
| Apr. 28, 1988 | [JP] | Japan | 63-104080 |
| Jun. 9, 1988 | [JP] | Japan | 63-140424 |
| Oct. 5, 1988 | [JP] | Japan | 63-249927 |
| Oct. 13, 1988 | [JP] | Japan | 63-255827 |

[51] Int. Cl.[5] ..... G03G 15/16

[52] U.S. Cl. ..... 355/274

[58] Field of Search ..... 355/219, 271, 273, 274, 355/277

[56] References Cited

U.S. PATENT DOCUMENTS

| | | | |
|---|---|---|---|
| 2,626,865 | 1/1953 | Mayo et al. | 355/274 X |
| 2,807,233 | 9/1957 | Fitch | 355/271 X |
| 3,700,324 | 10/1972 | Hutner et al. | 355/271 |
| 3,702,482 | 11/1972 | Dolcimascolo et al. | 364/74 ES |
| 3,751,156 | 8/1973 | Szostak et al. | 355/273 |
| 3,781,105 | 12/1973 | Meagher | 355/274 |
| 3,866,573 | 2/1975 | Szostak et al. | 118/637 |
| 3,879,121 | 7/1975 | Simpson | 355/274 |
| 3,918,966 | 11/1975 | Metcalfe et al. | 355/274 X |
| 3,920,325 | 11/1975 | Swift | 355/271 |
| 3,924,943 | 12/1975 | Fletcher | 355/274 |
| 3,936,175 | 2/1976 | Jones | 355/274 |
| 3,942,888 | 3/1976 | Maksymiak et al. | 355/277 |
| 3,954,333 | 5/1976 | Goel | 355/273 |
| 3,959,574 | 5/1976 | Seanor et al. | 428/425 |
| 4,026,648 | 5/1977 | Takahashi | 355/273 X |
| 4,063,808 | 12/1977 | Simpson | 355/274 |
| 4,309,803 | 1/1982 | Blaszak | 355/271 |
| 4,320,958 | 3/1982 | Fantuzzo | 355/270 |
| 4,338,017 | 7/1982 | Nishikawa | 355/274 X |
| 4,380,385 | 4/1983 | Ozaki et al. | 355/277 |
| 4,382,673 | 5/1983 | Nakajima et al. | 355/274 |
| 4,431,301 | 2/1984 | Hashimoto et al. | 355/274 |

FOREIGN PATENT DOCUMENTS

| | | |
|---|---|---|
| 323252 | 7/1989 | European Pat. Off. . |
| 329366 | 8/1989 | European Pat. Off. . |
| 2152501 | 4/1973 | Fed. Rep. of Germany . |
| 2517222 | 11/1975 | Fed. Rep. of Germany . |
| 3104212 | 12/1981 | Fed. Rep. of Germany . |
| 2211470 | 7/1989 | United Kingdom . |

*Primary Examiner*—Fred L. Braun
*Attorney, Agent, or Firm*—Foley & Lardner

[57] ABSTRACT

A method and device of toner image transfer for an electrophotographic printing apparatus capable of obtaining stable high quality images regardless of the environmental conditions. The device includes a transfer roller having an outermost resistive layer; a flexible conductive layer inside the outermost resistive layer which is electrically connected to the resistive layer; an elastically deformable elastic sponge rubber layer inside the conductive layer; a metallic shaft inside the elastic sponge rubber layer to which a transfer bias voltage is applied; and an elastically deformable elastic conductive portion electrically connecting the metallic shaft and the conductive layer. In carrying out the method, the transfer bias voltage is applied in pulsed form. Also, an area to be transferred is detected by a sensor, so that toner is supplied only to the detected area, while controlling a leveling blade located around a sleeve of a developing device for limiting the amount of toner on the sleeve, such that an amount of the toner supplied from the sleeve is changed.

58 Claims, 25 Drawing Sheets

TONER IMAGE TRANSFER METHOD AND DEVICE FOR ELECTROPHOTOGRAPHIC PRINTING APPARATUS

BACKGROUND OF THE INVENTION

1. Field of the Invention

The present invention relates to an electrophotographic printing method and apparatus to be utilized in a copy machine, a printer in general, a facsimile and like and, more particularly, to an electrostatic toner transfer system of such an electrophotographic printing and associated features.

2. Description of the Background Art

There are presently two types of apparatus for the electrostatic transfer of toner image from photoconductive drum to receiving paper, one using corona charger, and the other using a conductive roller or a drum with externally applied voltage, which is described in U.S. Pat. No. 2,626,865.

Of these two, the one using the corona charger is popular for general monochromatic copy machines because of its simple structure. In this type of apparatus, electric charges are produced by the corona charger as corona ions generated by applying several kV voltage through a fine tangsten wire. The generated charges are then applied to the receiving paper from behind so that the toner is transferred from the photoconductive drum to the receiving paper by the electric fields due to the charges attached on the receiving papers.

It has been noted by the present inventors that in such an apparatus, the strength of the electric fields varies for different receiving papers as different resistivities of the different receiving papers changes the amounts of charges attached on the different receiving papers because of the charge leakage through the receiving paper, even for the same amount of charges generated by the corona charger. Such a difference in the electric field strength for different receiving papers affects the toner transfer efficiency.

Now, since papers usually used as receiving papers change their resistivities significantly, according to the surrounding humidity, and since the difference in the electric field strength for different receiving papers affects the toner transfer efficiency, it has been difficult to achieve consistent color printing, because the color balance in the color printing, in which different color toner are superposed, tends to be disturbed. Even in monochromatic printing, the fluctuation in image density due to the variation in humidity is common.

There is also a problem of image disturbances due to scattering of toner on the receiving papers caused by spark discharge from charges on the receiving papers to the photoconductive drum, occurring in contacting and detaching the receiving papers from the photoconductive drum. These are problematic enough for monochromatic printing, but are especially so for color printing where the color toners are required to be accurately superposed.

There have been attempts to cope with such problems. One proposition is to utilize an insulating mesh, as described in Japanese Patent Laid Open No. S56-164370. However, the toner transfer efficiency still varies as the resistivity of the receiving papers is changed by the surrounding humidity.

Another proposition is to utilize a soft foamed conductive rubber roller, as described in Japanese Patent Laid Open No. S50-22640. In this method, high quality image is obtainable and, in addition, the transfer to thick receiving papers such as envelops and those receiving papers with uneven soft surface is possible.

However, it has been difficult to manufacture a foamed conductive rubber roller in accurate shape. Moreover, in order to make the foamed rubber roller conductive, conductive particles such as conductive carbon black are mixed in, but the elasticity of the roller is changed by the amount of mixture so that the desired elasticity has been difficult to obtain. There is also a problem concerning the discharge inside of the foamed conductive rubber roller, which shorten the lifetime of the roller as well as worsen the image quality.

Furthermore, even with the foamed conductive rubber roller the toner transfer efficiency varies somewhat according to the surrounding humidity when the receiving papers are the usual papers used. This is particularly problematic for the color printing which requires a stable toner transfer efficiency, since this may cause fluctuations in colors among different printings. For this reason, it has been necessary to an set the resistivity of the roller to appropriate value which can deal effectively with the variation of the surface resistivity of the receiving papers for different humidities and different receiving papers, as described in Japanese Patent Laid Open No. S50-150437. This calls for diffusing conductive bodies of same type uniformly at constant density into the rubber, which has been extremely difficult.

In addition, when the contact pressure between the roller and the photoconductive drum is large, there appears a deterioration of the image called 'middle blank' where the toner in the middle of the image is not transferred to the receiving papers. The image can also be deteriorated by the fluctuation of the image densities due to the change of the contact pressure between the roller and the photoconductive drum, caused by such things as the machine vibration. This latter becomes particularly prominent in high humidity conditions.

Moreover, it is necessary in this method to have structural complication due either to an accurate gap setting between the roller and the photoconductive drum or a pivotal configuration for a transfer roller.

The toner transfer efficiency can also be affected by the transfer bias voltage used in the electrostatic toner transfer.

Namely, for the toner transfer using the corona charger, the toner transfer efficiency increases as the transfer bias voltage is increased, but only up to some maximum toner transfer efficiency. Any further increase of the transfer bias voltage beyond this reduces the toner transfer efficiency. The best transfer bias voltage giving the maximum toner transfer efficiency tends to take higher values for more humid environment, and the maximum toner transfer efficiency tends to get lower for such case.

The present inventors has noted that this is caused by the fact that as the surrounding humidity increases the surface resistivity of the receiving papers decreases because of the moistening, which in turn causes the leakage of the corona charges, resulting in increase of the transfer bias voltages, and that as the volume resistivity decreases, the amount of inverse charges given by the receiving papers to the transferred toner increases, so that there are increased amount of the inversely transferred toner which returns to the photoconductive drum. Here, the transfer time is determined by the time taken by the receiving papers to pass through the corona charger, and this same time also gives the time for toner layer voltage, the time for the toner to transfer, and the time for the inverse charges to be given from the receiving paper to the transferred toner. This means that the toner transfer efficiency can be improved by setting an appropriate transfer time. This is also true for the transfer using the roller.

However, it has also been noted by the present inventors that, for a transfer using the roller, the toner, transfer efficiency also depends on the resistivity of the roller. Namely, for the resistivity of the roller more than $10^9\Omega\cdot cm^2$, the toner transfer efficiency drops off as the transfer bias voltage to be applied to the toner layer on the photoconductive drum decreases, while for the resistivity of the roller less than $10^7\Omega\cdot cm^2$, the transfer bias voltage increases too much, such that the excessive inverse charges given to the toner give rise to the increase of the inversely transferred toner.

Another problem associated with the electrophotographic printing is that a user must take the trouble of emptying an excess toner container regularly before it overfills, and refilling the emptied toner supply. One main cause for the increase of such excess toner is developing of the area on the photoconductive drum which is outside of the area to be covered by receiving papers of certain size. This ends up in wasting all of the toner on these extraneous areas, thereby increasing the amount of excess toner as well as consumed toner.

To cope with this problem, there has been made a proposition to control the corona charger so as to reduce the wasteful operation, as described in Japanese Patent Laid Open No. S56-140370. There is also another proposition to provide an additional light source for deletion of the electrostatic latent images on the photoconductive drum at the extraneous area, as described in Japanese Patent Laid Open No. S59-160159.

However, these are both attempts to control the toner electrostatically, so that they offer no solution for toner which cannot be controlled electrostatically, such as uncharged toner and toner which is physically adhered to the photoconductive drum. As a matter of fact, the amount of so called fog toner attached on the portion of the photoconductive drum without an electrostatic latent image is rather large, and rapidly increases as the photoconductive drum deteriorates. Moreover, the use of an additional light source creates various problems related to the cost, the available space, and the promotion of deterioration of the photoconductive drum due to increased illumination.

In addition, for the transfer using transfer roller, the contact between the transfer roller and the photoconductive drum with the residual toner causes the attachment of the toner onto the transfer roller, resulting in staining the backs of the receiving papers.

To cope with this problem there are propositions to separate the transfer roller from the photoconductive drum when there are no image receiving papers, as described in Japanese Patent Laid Open No. S48-40442, and to give the transfer roller a bias voltage of the same polarity as that of the toner, as described in Japanese Patent Laid Open No. S51-9840.

However, the former requires a complex mechanism for driving the transfer roller, which creates problems of size and cost, while the latter is unable to deal with those which cannot be controlled electrostatically, such as uncharged toner and toner which is physically adhered to the photoconductive drum.

As a solution to this situation, there is the proposition of a cleaning blade which wipes off the attached toner from the transfer roller, as described in Japanese Patent Laid Open No. S48-68239.

Such a cleaning blade for the transfer roller is shown in FIG. 1. The cleaning blade 301 makes a contact with the transfer roller 302 at a contact point 303 on the transfer roller 302, and good cleaning efficiency can be obtained by making an acute angle $\alpha$ between the cleaning blade 301 and a tangent line 304 of the transfer roller 302 at the contact point 303, and placing a support point 305 of the cleaning blade 301 before the contact point 303 with respect to a direction of rotation A of the transfer roller 301.

But, with this configuration, where the support point 305 is underneath the transfer roller 301, not only the supporting member 306 of the cleaning blade 301 gets dirty with the fall of the wiped-off toner, but also the accumulation of the fallen wiped-off toner on the supporting member 306 may interfere with the falling of the wiped-off toner itself so that the retrieval of the wiped-off toner becomes difficult.

Furthermore, this cleaning blade 301 is not effective for a soft transfer roller and causes the staining of the transfer roller 302 and the backs of the image receiving papers, as well as imperfect transfer.

Moreover, with this cleaning blade 301, a user still must take the trouble of emptying an excess toner container regularly before it overfills, which can be very frequent when the amount of the toner on the transfer roller 302 increases.

There are also other problems associated with these rollers. To put matters in perspective, it is to be noted first that the process of the electrophotographic printing essentially comprises of the following steps.

(1) the charging step in which the surface of the photoconductive drum is charged by the corona charger;

(2) the exposure step in which the surface of the photoconductive drum is exposed to light from the light source, such as a laser diode, which oscillates between On and Off states in accordance with the input signals, such that the electrostatic latent image is formed on the photoconductive drum;

(3) the developing step in which the developer such as toner is provided to visualize the electrostatic latent image on the photoconductive drum;

(4) the transfer step in which the visualized toner image is transferred onto the receiving paper;

(5) the cleaning step in which the residual image left over on the photoconductive drum after the transfer step is cleaned out; and (6) the fixing step in which the toner image on the receiving paper is fixed by heating or other methods.

An example of a conventional laser printer performing in this manner is shown in FIG. 2.

In this laser printer, the surface of the photoconductive drum 101 is uniformly charged by the negative corona charger 102, and this surface of the photoconductive drum 101 is exposed to the scanning laser beams from the scanner 103 which oscillates between On and Off states in accordance with the input signals. The negative charges on the exposed portion of the photoconductive drum 101 are discharged and the electrostatic latent image is formed on the photoconductive drum 101. The electrostatic latent image is developed by the developing unit 104 equipped with developing roller carrying negatively charged toner. The toner image on the photoconductive drum 101 is then transferred onto the receiving paper S by positive charger 105, and the transfer sheet S is sent to the fixing unit 109 in which the toner image is fixed on the receiving paper S. Meanwhile there is some residual toner left on the photoconductive drum 101 after the transfer step. Such residual toner is cleaned by the cleaning blade 107*a* of the cleaning unit 107. Then, the entire photoconductive drum 101 is illuminated by the discharging lamp 106 to remove all the remaining charges, before returning to the negative corona charger 102 to repeat the process.

The excess toner collected at the cleaning step is accumulated in an excess toner container not shown, and such a user must take the trouble of emptying such an excess toner container regularly before it gets overfilled.

Also, the cleaning step is carried out by the cleaning device with the cleaning blade 107*a*, which is pressed against the photoconductive drum 101 to wipe along the surface of the photoconductive drum 101, which may mechanically causes damages on the photoconductive drum 101, or result in forming a film of the toner on the surface of the photoconductive drum, which can deteriorate the image quality.

One proposition to cope with this situation is to perform the developing step and the cleaning step altogether by single means, which is described in the Japanese Patent Laid Open No. S59-133573. This is based on the fact that in the electrophotographic process using reversing developing device, the charging of the photoconductive drum can be uniform regardless of the presence of the residual toner, and that with the transfer efficiency of more than 70% it is possible for the charges on the photoconductive drum to be discharged even when they are under the residual toner.

However, even in this case, some memory images appear, especially under high humidity conditions. This is due to the fact that under the high humidity conditions the transfer efficiency often drops below 70%.

SUMMARY OF THE INVENTION

It is therefore the object of the present invention to provide a method and an apparatus for electrophotographic printing, which can largely be free of the influence from surrounding humidity conditions, and in which it is possible to obtain desired elasticity and the resistivity on the electrostatic toner transfer roller, such that the stable high quality images can be obtainable regardless of the environmental conditions.

Another object of the present invention is to provide a method and an apparatus for electrophotographic printing which does not cause transfer bias voltage fluctuation, photoconductive drum damage, and staining of the backs of receiving papers.

Another object of the present invention is to provide an apparatus for electrophotographic printing which incorporates a cleaning mechanism that can be so effective for the soft roller that the stable high quality images can be obtainable with high toner transfer efficiency.

Another object of the present invention is to provide a method and an apparatus for electrophotographic printing in which the excess toner from the photoconductive drum as well as toner consumption can be reduced so that the staining of the receiving papers can be prevented and the maintenance by the user can be simplified.

Another object of the present invention is to provide an apparatus for electrophotographic printing in which a conventional cleaning device can be eliminated without the appearance of the residual images due to the residual toner on the photoconductive drum.

According to one aspect of the present invention there is provided a transfer device for an electrophotographic printing apparatus, in which a toner image formed by toner is to be transferred onto a receiving paper, comprising: photoconductive drum means for carrying the toner image formed in accordance with an electrostatic latent image formed thereon; transfer roller means which makes contact with the photoconductive drum means for effectuating the transfer of the toner image onto the receiving paper, the receiving paper being conveyed between the transfer roller means and the photoconductive drum means, the transfer roller means including: outermost resistive layer which makes contact with the receiving paper; flexible conductive layer to be inside and electrically connected to the resistive layer; and an elastically deformable elastic layer inside the conductive layer; and transfer bias voltage source means for applying a transfer bias voltage which causes the transfer of the toner image, to the resistive layer of transfer roller means.

According to another aspect of the present invention there is provided a transfer device for an electrophotographic printing apparatus, in which a toner image formed by a toner is to be transferred onto a receiving paper, comprising: photoconductive drum means for carrying the toner image formed in accordance with a electrostatic latent image formed thereon; transfer roller means which makes contact with the photoconductive drum means for effectuating the transfer of the toner image onto the receiving paper, the receiving paper being conveyed between the transfer roller means and the photoconductive drum means, the transfer roller means having an outer surface which makes contact with the receiving paper and which has a resistivity which decreases as atmospheric vapor pressure increases; and transfer bias voltage source means for applying a transfer bias voltage which causes the transfer of the toner image, to the transfer roller means.

According to another aspect of the present invention there is provided a method of toner image transfer for an electrophotographic printing apparatus, in which a toner image formed by a toner is to be transferred onto a receiving paper, comprising the steps of: forming an electrostatic latent image on an photoconductive drum; developing the electrostatic latent image by the toner to obtain the toner image; transferring the toner image onto the receiving paper by conveying the receiving paper to a transfer area, and by applying a transfer bias voltage in pulsed form to the receiving paper.

According to another aspect of the present invention there is provided a transfer device for an electrophotographic printing apparatus, in which a toner image formed by a toner is to be transferred onto a receiving paper, comprising: photoconductive drum means for carrying the toner image formed in accordance with an electrostatic latent image formed thereon; transfer roller means which makes contact with the photoconductive drum means for effectuating the transfer of the toner image onto the receiving paper, the receiving paper being conveyed between the transfer roller means and the photoconductive drum means; transfer bias voltage source means for applying a transfer bias voltage which causes the transfer of the toner image, to the transfer roller means; developing means for supplying toner to the electrostatic latent image on the photoconductive drum means; sensor means for detecting an area on the photoconductive drum means to be given the toner from the developing means; and toner control means for controlling the developing means such that toner is supplied only to those area detected by the sensor means.

According to another aspect of the present invention there is provided a method of toner image transfer for an electrophotographic printing apparatus, in which a toner image formed by a toner is to be transferred onto a receiving paper, comprising the steps of: forming an electrostatic latent image on an photoconductive drum; detecting an area on the photoconductive drum to be given the toner from the developing means; developing the detected area by toner to obtain the toner image; and transferring the toner image onto the receiving paper by conveying the receiving paper to a transfer area, and by applying a transfer bias voltage to the receiving paper.

Other features and advantages of the present invention will become apparent from the following description taken in conjunction with the accompanying drawings.

DETAILED DESCRIPTION OF THE PREFERRED EMBODIMENTS

Figure 3:
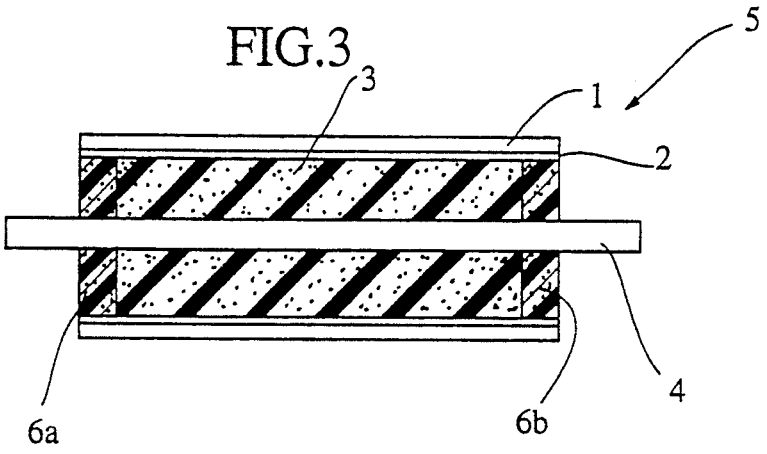
FIG. 3 is a longitudinal sectional view of one embodiment of the transfer roller to be incorporated in the electrophotographic printing apparatus according to the present invention.

Referring now to FIG. 3, there is shown one embodiment of the transfer roller to be incorporated in the electrophotographic printing apparatus according to the present invention.

In this embodiment, the transfer roller 5 comprises coaxial layers including a resistive layer 1, a conductive layer 2 inside the resistive layer 1, an insulating elastic sponge rubber 3 inside the conductive layer 2, and a metallic shaft through the center. The elastic sponge rubber 3 includes conductive portions 6*a* and 6*b* near the side edges which electrically connects the conductive layer 2 and the metallic shaft 4.

This transfer roller has isolated mechanical and electrical functions, so that the roller hardness can be adjusted by selecting the elastic sponge rubber 3 while the roller resistivity can be adjusted by selecting the resistive layer 1.

The resistive layer 1 is made of either resin such as polyester resin, polyethylene resin, fluoride resin, vinyl chloride resin, rubber diffused with fine conductive particles, such as conductive carbon, copper, or nickel, or flexible resistive sheets, such as conductive polymer resin. The resistivity per unit area of the resistive layer 1 is preferably in a range of $1\times10^{7}$–$1\times10^{10}\Omega\cdot cm^2$, within which a range $1\times10^{8}$–$5\times10^{8}\Omega\cdot cm^2$ is particularly desirable. Such a resistivity per unit area can be obtained by changing the amount of the fine conductive particles to be diffused in the resin or the rubber, or by changing the amount of ion doners to be mixed into a polymer resin, such as fluoride resin. Also, the resistivity of the resistive layer 1 is preferably free or almost free of influences from the environmental humidity. In this regard, the resin sheet structure has a resistivity more stable with respect to changes in humidity than a foamed structure, as the resin sheet structure does not invovlve air foams. This enables the resin sheet structure to maintain a constant electrical and mechanical toner transfer conditions regardless of the environmental humidity, for receiving papers of various different thickness such as papers, envelops, and postcards to be placed between the transfer roller 5 and the photoconductive drum. Also, for the sake of cleaning accumulated residual toner on roller surface which causes staining of the back of the receiving papers, a surface of the resistive layer 1 is preferably as smooth as possible. The thickness of the resistive layer 1 is desirably as thin as to be in a range of 0.02–2 mm, so as not to interfere with the flexibility of the elastic sponge rubber 3.

The conductive layer 2 is made of either conductive resin made by diffusing fine conductive particles such as those of conductive carbon into resin such as polyester, or thin metallic sheets, or else conductive adherents. It is important that conductive layer 2 be both conductive and flexible. The volume resistivity of the conductive layer 2 needs to be sufficiently less than that of the resistive layer 1, so that it must be less than $10^6\ \Omega\cdot cm$, or more preferably less than $10^5\ \Omega\cdot cm$. In addition, it is important that the resistive layer 1 and the conductive layer 2 are electrically connected, and the thickness of the conductive layer 2 is also desirably as thin as possible so as not to interfere with the flexibility of the elastic sponge rubber 3. The sufficient flexibility of the elastic sponge rubber 3 can be retained by making the total thickness of the resistive layer 1 and the conductive layer 2 to be less than 1/10 of that of the elastic sponge rubber 3.

The elastic sponge rubber 3 is made of compressibly deformable elastic body such as foamed sponge rubber, foamed polyethylene, or foamed urethane. As a part of the transfer roller 5 is to make tight contact with the photoconductive drum, the elastic sponge rubber 3 needs to be capable of reliably repeat deforming flexibly at a tightly contacting position and recovering its original shape at a release position. In other words, the elastic sponge rubber 3 is preferably capable of high anti-creep and anti-plastic deformation. The foamed structure may either be a continuous foam structure or a separate foam structure, but the continuous foam structure is more desirable as it is more stable shape-wise with respect to the surrounding temperature. The flexibility of the elastic sponge rubber 3 can be freely selected by changing the material composition, foamed structure and amount of foam, and the hardness, as long as it is less than that corresponding to 30 degrees for Japanese Industrial Standard (JIS) of the sponge rubber with a separate foamed structure. To be sufficiently flexible, the thickness of the elastic sponge rubber 3 needs to be more than 2 mm.

The conductive portions 6*a* and 6*b* are composed of sponge rubber with conductive particles, and is harder than the elastic sponge rubber 3. These conductive portions 6*a* and 6*b* of the elastic sponge rubber ends 3 electrically connect the conductive layer 2 and the metallic shaft 4, so that by supplying electricity to the metallic shaft 4 voltages can be applied to the resistive layer 1.

Such a transfer roller 5 was manufactured as follows. A 10 mm thick layer of urethane sponge rubber with the hardness corresponding to 20 degrees for JIS was formed around a SUS shaft of 8 mm diameter. Then, approximately 5 mm from both edges of this urethane sponge rubber were made to possess the volume conductivity of $10^4\ \Omega\cdot cm$. This urethane sponge rubber was covered with the conductive layer of the volume resistivity $10^4\ \Omega\cdot cm$ and the resistive layer of the resistivity per unit area $10^8\ \Omega\cdot cm^2$, both of which are made of polyester resin diffused with conductive carbon or fluoride resin with conductive ion doner, for 0.1 mm thickness each.

Figure 4:
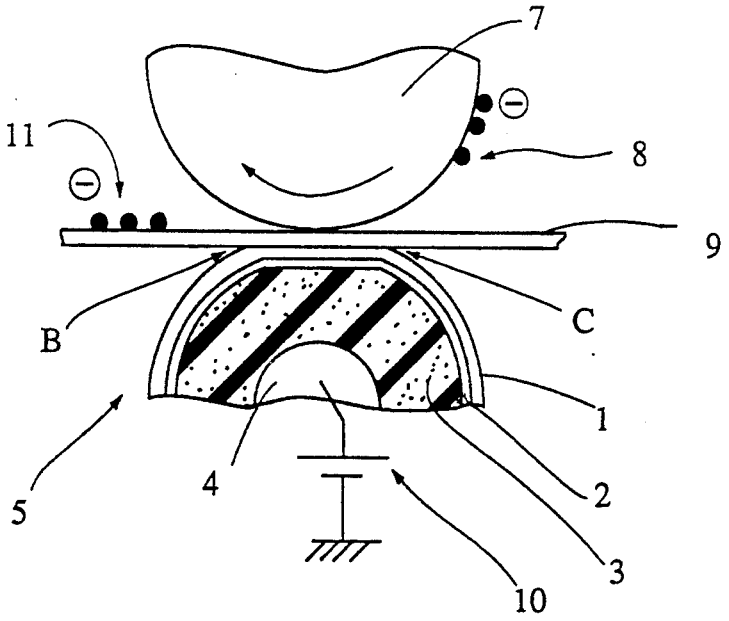
FIG. 4 is a schematic cross sectional view of the transfer device using the transfer roller of FIG. 3.

Referring now to FIG. 4, the toner transfer device using the transfer roller 5 of FIG. 3 will be explained.

In this transfer device, a receiving paper 9 is to be fed in between the transfer roller 5 and an photoconductive drum 7 conveying a toner image 8. As the photoconductive drum 7 rotates in a direction indicated by an arrow, the toner image 8 on the photoconductive drum 7 is brought into a transfer area between points B and C, and makes contact with the receiving paper 9 there. At this point, there is a transfer bias voltage of approximately 1 to 3 kV with a polarity opposite to that of the toner charges (negative in FIG. 4) applied from a high voltage generator 10 to the toner image 8, so that the toner image 8 is electrostatically transferred to the receiving paper 9 and forms an image 11 on the receiving paper 9. At the transfer area between the points B and C, the photoconductive drum 7 and the receiving paper 9 is in tight contact with a wide nip width because of the elastic deformation of the elastic sponge rubber 3 of the transfer roller 5. The flexible structure of the elastic sponge rubber 3 also maintain the constantly low transfer pressure in this transfer area as well. Also, a uniform transfer condition is obtainable over a wide range of mechanical roller movement, because the transfer roller 5 is softly in contact with the photoconductive drum 7 generally, and the resistivity of the resistive layer 1 is almost independent of the applied pressure.

Now, in a transfer by roller, in general, excessive transfer pressure prevents the toner from being transferred onto the receiving paper 9 in a middle region. For instance, only outline edges of the letter images may be transferred with blanks inside. The relationship between the probability for occurrence of such 'middle blank' and the transfer pressure for the transfer device of FIG. 4 is plotted in FIG. 5 in which the probability for occurrence of middle blank is represented by a ratio of blank area within a prescribed square image. In practice, it is satisfactory when this ratio is less than 10. Thus, for the transfer device of FIG. 4, the transfer pressure within a range of 20–300 g/cm$^2$ is suitable and, in particular, that within a range of 20–200 g/cm$^2$ is preferable. It is also to be noted that the relationship of FIG. 5 holds for the transfer roller 5 with the elastic sponge rubber having the hardness equal to or less than that corresponding to 30 degrees JIS.

Figure 6:
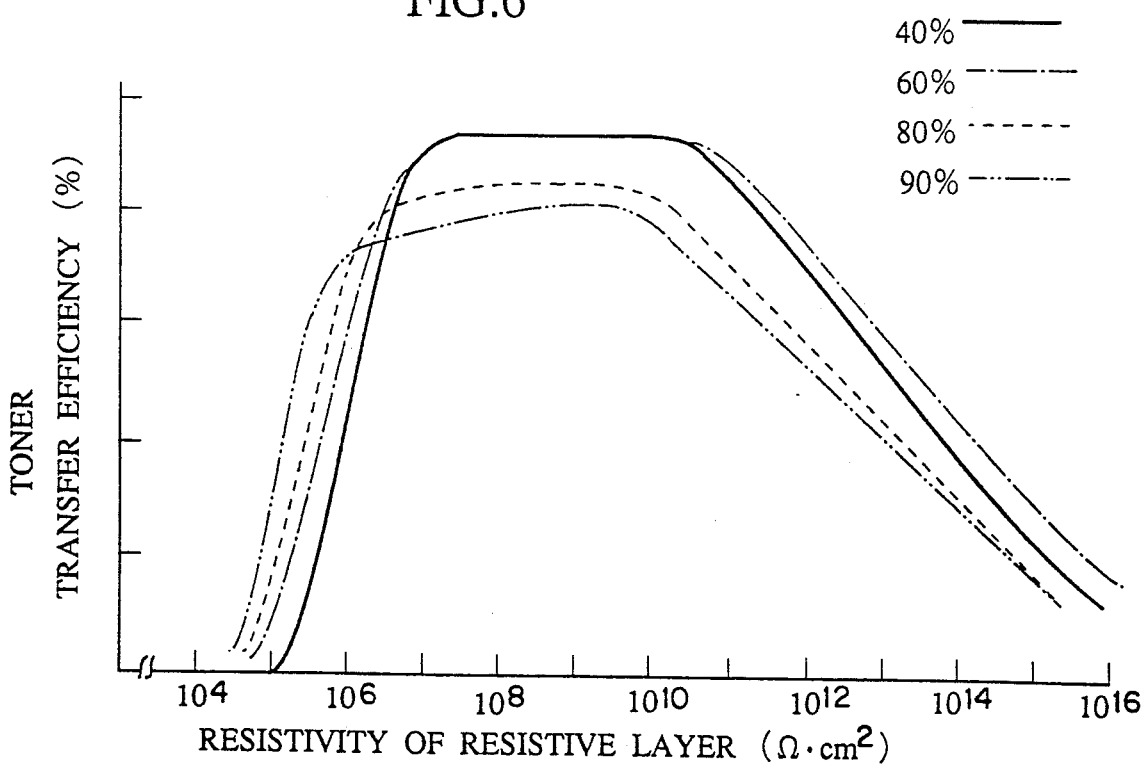
FIG. 6 is a graph of the toner transfer efficiency versus the resistivity of the transfer roller under different surrounding humidities for the transfer device of FIG. 3.

The relationship between the volume resistivity of the resistive layer 1 and the toner transfer efficiency for the transfer device of FIG. 4 is shown in FIG. 6 for four different environmental humidities. In FIG. 6, the toner transfer efficiency is represented by a ratio of an amount of the toner transferred to the receiving paper 9 with respect to a sum of that amount and an amount of the toner left on the photoconductive drum 7.

Now, the resistive resin sheets of the resistive layer 1 can be designed solely from the point of view regarding its electrical characteristics. Inadequately small volume resistivity results in a severe decrease in the toner transfer efficiency due to the discharging between the resistive layer 1 and the photoconductive drum 7 when the transfer bias voltage is applied, or production of the inverse toner transfer caused by the charge injection from the receiving paper 9 to the toner image 8. On the other hand, the excessive volume resistivity also results in the decrease of the toner transfer efficiency due to the dropping of the transfer bias voltage distributed to the toner layer itself. Thus, for the transfer device of FIG. 4, the resistivity per unit area within a range of $1\times10^7$–$1\times10^{10}$ $\Omega\cdot cm^2$ is suitable and, in particular, that in a range of $1\times10^8$–$5\times10^8$ $\Omega\cdot cm^2$ is preferable. As shown in FIG. 6, with the resistivity within this preferable range the toner transfer efficiency higher than 80% is obtainable by the transfer device of FIG. 4 even with an environmental humidity of over 80% RH.

Thus, in this embodiment of the transfer device, it is possible to maintain stable transfer conditions both mechanically and electrically, and high toner transfer efficiency is obtainable even for a high environmental humidity, so that highly satisfactory image production becomes possible.

There are several other embodiments possible for the transfer roller which can most effectively be viewed as improvements on the first embodiment described above, and these other embodiments will now be described.

Figure 7:
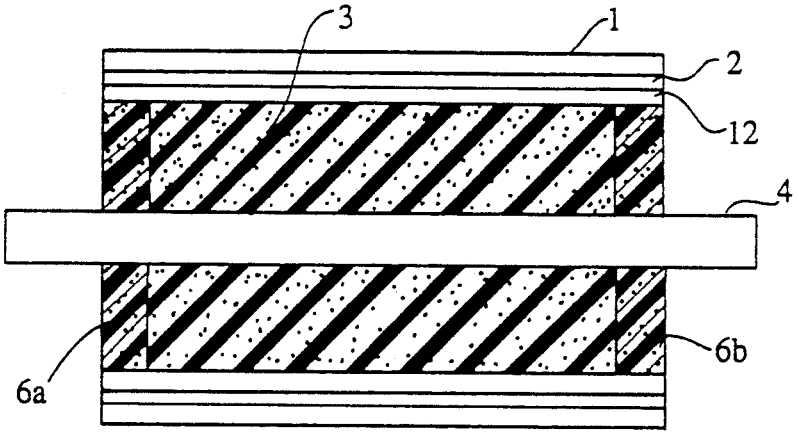
FIG. 7 is a longitudinal sectional view of second embodiment of the transfer roller to be incorporated in the electrophotographic printing apparatus according to the present invention.

As a second embodiment of the transfer roller, FIG. 7 shows a transfer roller which has a conductive rubber layer 12 between the conductive layer 2 of the polyester resin sheets and the elastic sponge rubber 3 of the foamed rubber sponge. This transfer roller is useful when the reinforcement for the adherence between the conductive layer 2 of polyester resin sheets and the elastic sponge rubber of the foamed rubber sponge 3 is desirable. The rest of this third embodiment of FIG. 7 is substantially identical to the first embodiment of FIG. 3.

Figure 8:
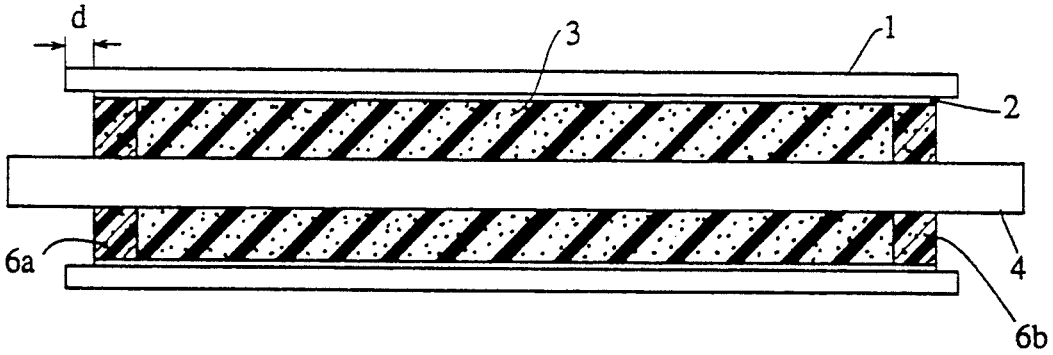
FIG. 8 is a longitudinal sectional view of third embodiment of the transfer roller to be incorporated in the electrophotographic printing apparatus according to the present invention.

As a third embodiment of the transfer roller, FIG. 8 shows a transfer roller in which the resistive layer 1 is made longer along a direction of axis than the conductive layer 2 and the elastic sponge rubber 3, so that length d from each edge of the resistive layer 1 extends outwardly. This length d is preferably within a range of 0.5–5 mm for the reason to be explained below. In manufacturing, the resistive layer can be made sufficiently longer along a direction of the axis than the conductive layer 2 and the elastic sponge rubber 3, and then be cut to have the edges extending out for a length d.

Figure 9:
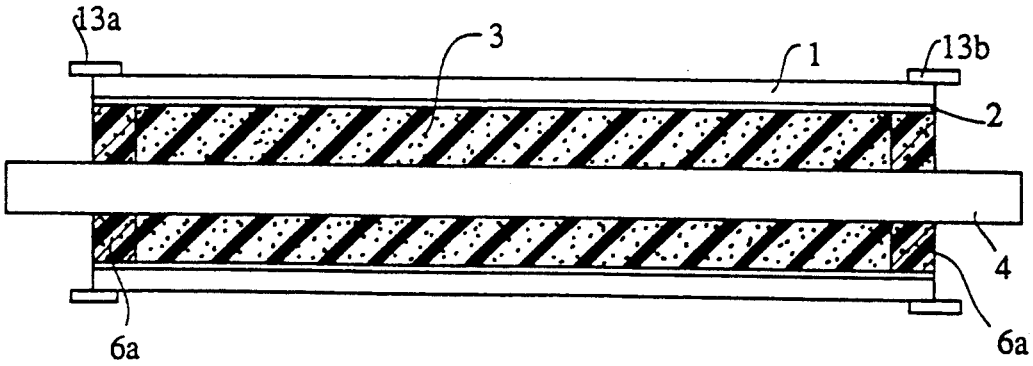
FIG. 9 is a longitudinal sectional view of fourth embodiment of the transfer roller to be incorporated in the electrophotographic printing apparatus according to the present invention.

Also as a fourth embodiment of the transfer roller, FIG. 9 shows a transfer roller similar to that of FIG. 8 but the extensions at the edges of the resistive layer 1 are obtained by attaching thin insulative tapes **13*a* and 13*b* at the edges of the resistive layer 1 of the transfer roller of FIG. 3. The insulative tapes 13*a* and 13*b* are preferably very smooth and durable against the abrasion. The rest of these third and fourth embodiments of FIGS. 8 and 9 are substantially identical to the first embodiment of FIG. 3**.

Figure 10:
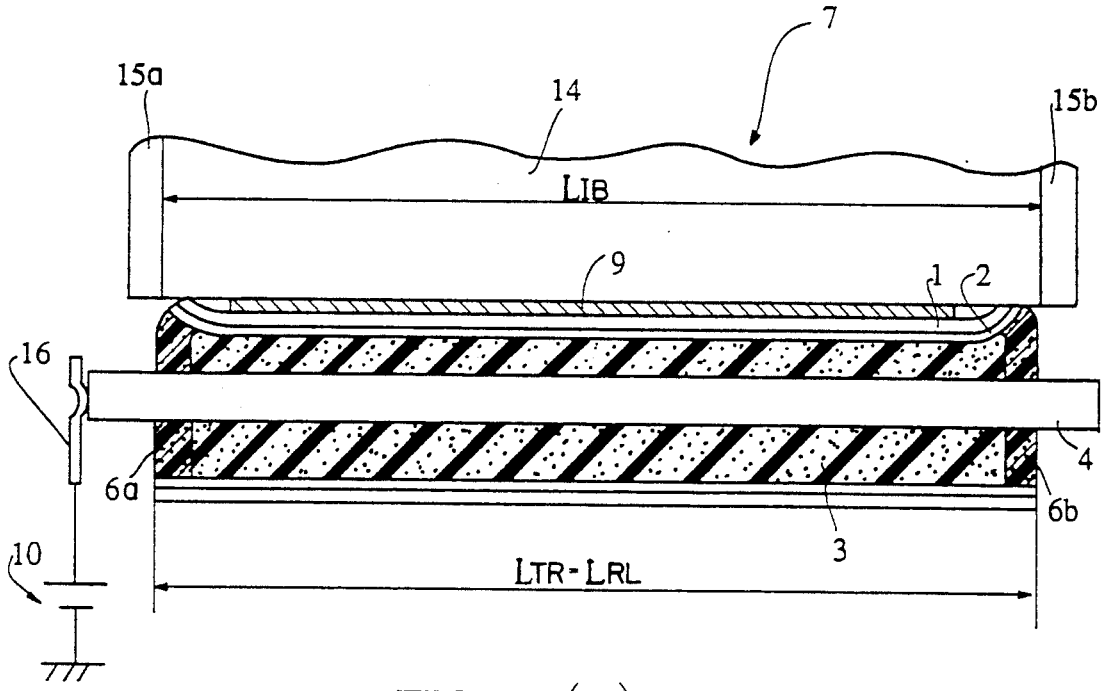
FIG. 10(A) and (B) are longitudinal sectional views of the transfer devices using the transfer rollers of FIGS. 3 and 8, respectively, for explaining the difference between the two embodiments.
Figure 10:
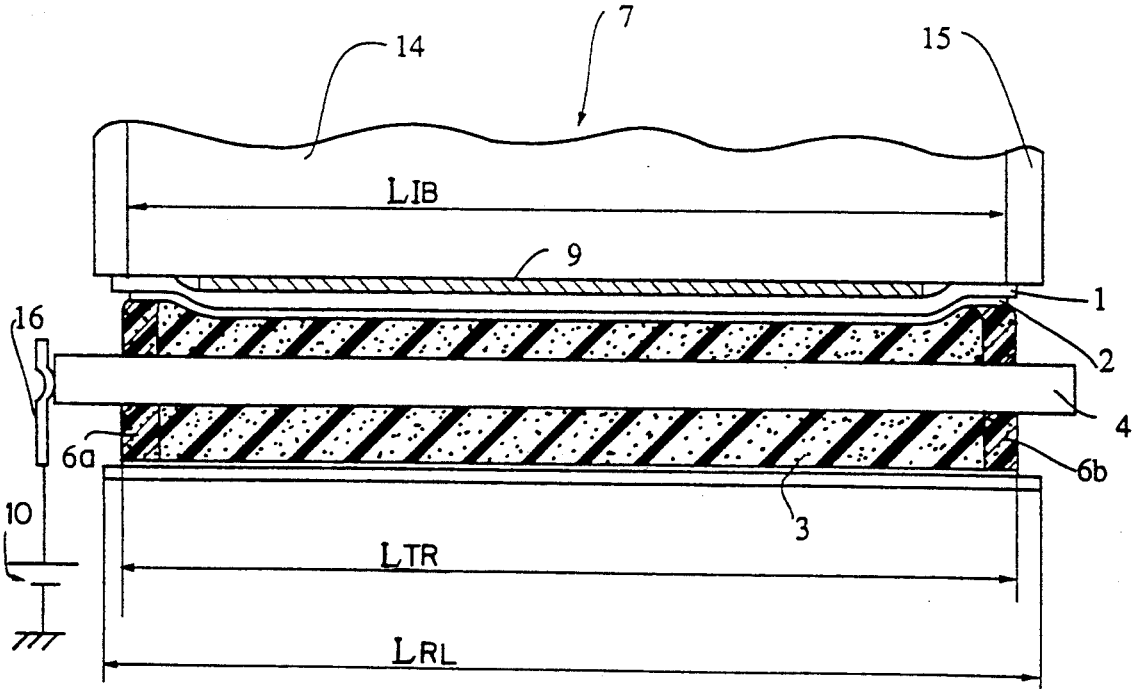

Referring now to FIGS. 10(A) and (B), the operation of the transfer device using the third embodiment of the transfer roller of FIG. 8 will be explained that of the first embodiment. Needless to mention, the following description of the operation for the third embodiment of FIG. 8 equally applies to the fourth embodiment of FIG. 9.

FIG. 10(A) shows a transfer device using the transfer roller of the first embodiment, whereas FIG. 10(B) shows a situation for the transfer device using the transfer roller of the third embodiment. In either situation, the transfer roller has a length $L_{TR}$ along the axis, the resistive layer 1 has a length $L_{RL}$ along the axis, and the photoconductive drum 7 has a photosensitive portion 14 of a length $L_{IB}$ along the axis and plastic frames **15*a* and 15*b* at each edges of the photosensitive portion 14. In addition, in FIG. 10(B) the resistive layer 1 extends out for 2 mm on both edges so that $L_{TR}=L_{RL}+4$ mm. The high transfer bias voltage of the polarity opposite to that of the toner is applied from the high voltage generator 10 through a spring board 16 contacting the metallic shaft 4** to the transfer roller in both situations.

In a situation of the transfer device using the transfer roller of the first embodiment shown in FIG. 10(A), the length of the transfer roller $L_{TR}$ is shorter than that of the photosensitive portion 14 of the photoconductive drum 7 which is $L_{IB}$. Thus, when the receiving paper 9 whose width is less than the length $L_{TR}$ of the transfer roller is inserted between the transfer roller and the photoconductive drum 7, the edges of the elastic transfer roller deforms as shown such that the edges of the conductive layer 2 come very close to or may even touch the photoconductive drum 7. When the transfer bias voltage is applied in such a situation, there can be discharging between the conductive layer 2 and the photoconductive drum 7, or the contact between the conductive layer 2 and the photoconductive drum 7 may form a short-circuit. As a result, the transfer bias voltage becomes unstable which causes density fluctuations in the image, and the pinholes appears on the photosensitive portion 14 which spoil the photoconductive drum 7.

On the other hand, in a situation of the transfer device using the transfer roller of the third embodiment shown in FIG. 10(B), the length of the transfer roller $L_{TR}$ is longer than that of the photosensitive portion 14 of the photoconductive drum 7 which is $L_{IB}$, so that the edges of the conductive layer 2 do not come very close to or touch the photoconductive drum 7, and so consequently there is no discharging between the conductive layer 2 and the photoconductive drum 7, nor any short-circuit due to contact between the conductive layer 2 and the photoconductive drum 7. Thus, with the third embodiment of the transfer roller, the transfer bias voltage can be stable without causes density fluctuations in the image, and no pinholes are produced on the photosensitive portion 14. The preferable range for the length d of the each extended portion of the resistive layer 1 is determined from the condition that there is no spark discharging for the high transfer bias voltage of 3 kV, which provides a lower limit of 0.5 mm, and that it is not too long to break off by fatigue due to deformation, which provides an upper limit of 5 mm.

It is to be noted that the transfer roller of the first embodiment can be free of these problems simply by having the length $L_{TR}$ longer than the length $L_{IB}$ of the photosensitive portion 14 of the photoconductive drum 7, but there still remains the problems such as that of available space, vibration of the transfer roller along the direction of axis, and the possibility of extreme deformation. The transfer roller of the fourth and fifth embodiments makes such considerations unnecessary, without adding complications in manufacturing.

As a fifth embodiment of the transfer roller, the composition of the resistive layer 1 in the first embodiment of FIG. 3 is modified as follows.

In this fifth embodiment, the resistive layer 1 possesses the characteristic that its resistivity decreases as the atmospheric vapor pressure increases. Such a resistive layer 1 can be made of either conductive polyvinylidene fluoride, polyurethane, polysilicone, or polyester, with conductive carbon diffused therein. The resistivity per unit area of the resistive layer 1 is preferably in a range of $1\times10^7$–$5\times10^9\Omega\cdot cm^2$, when the atmospheric vapor pressure is in a range of 10–40 mb.

As in the first embodiment of FIG. 3, the resistive layer 1 is to have a sheet structure so that it has a resistivity more stable with respect to changes in humidity than foamed structure as the sheet structure does not involves air foams. This enables the sheet structure to maintain a constant electrical toner transfer conditions regardless of the environmental temperature and humidity, for receiving papers of different thickness such as papers, envelopes, and postcards between the transfer roller and the photoconductive drum. Also, for the sake of cleaning accumulated residual toner off the surface, which causes staining of the back of the receiving papers, the resistive layer 1 is preferably as smooth as possible. The thickness of the resistive layer 1 is desirably thin enough to be in the range of 0.02–2 mm, so as not to interfere with the flexibility of the elastic sponge rubber 3.

In addition, the resistive layer 1 in this fifth embodiment preferably has the resistivity largely independent of the applied pressure, to ensure the stable supply of the transfer bias voltage to the toner. Here, the resistivity completely independent of the applied pressure is clearly more desirable, but that which has a linear relationship with the applied pressure, or that which has a step function like relationship with the applied pressure around a certain threshold, may also be used.

The rest of this fifth embodiment is substantially identical to the first embodiment of FIG. 3.

Such a transfer roller according to the fifth embodiment was manufactured as follows. A 10 mm thick layer of urethane sponge with the hardness corresponding to that of 20 degrees JIS was formed around SUS shaft of 8 mm diameter. Then, approximately 5 mm from both edges of this urethane sponge rubber layer were made to possess the volume conductivity of $10^4\Omega\cdot cm$. This urethane sponge rubber layer was covered with the conductive layer of a volume resistivity $2\times10^6\Omega\cdot cm$ and a resistive layer of resistivity $1\times10^8\Omega\cdot cm^2$, both of which are made of polyvinylidene fluoride, of 0.1 mm thickness each.

Also, for comparison, the transfer roller with its resistive layer covered by approximately 50 μm thick polyvinylidene chloride was manufactured as a transfer roller largely independent of the environmental humidity, according to Japanese Patent Laid Open No. S51-59636.

Figure 11:
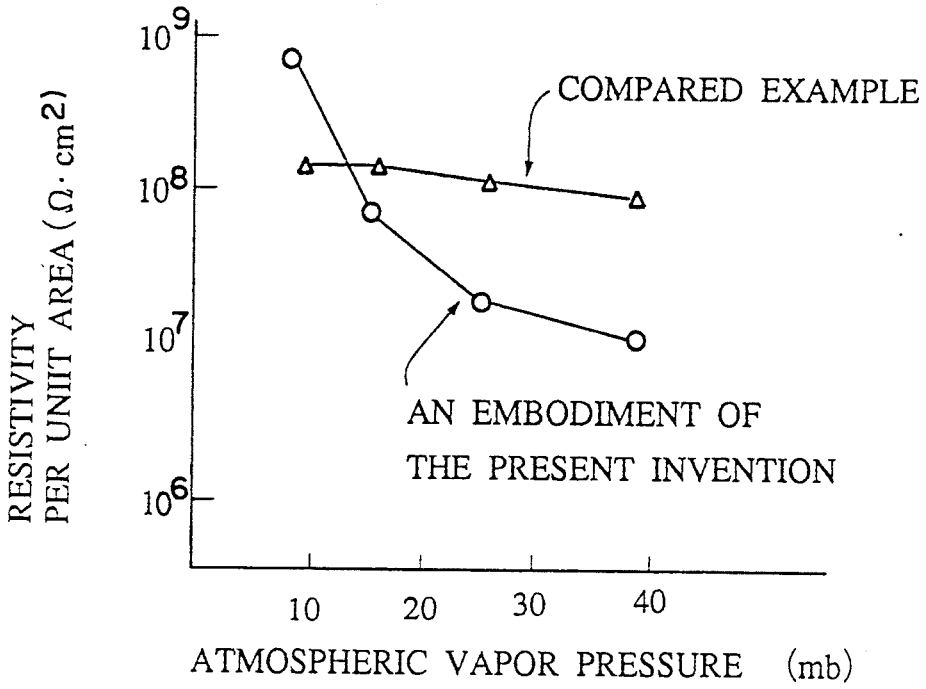
FIG. 11 is a graph of the resistivity per unit area of the transfer roller versus the vapor pressure of the atmosphere, for a fifth embodiment of the transfer roller to be incorporated in the electrophotographic printing apparatus according to the present invention.

The relationship between the resistivity per unit area and the atmospheric vapor pressure with the transfer bias voltage of 1.5 kV for these two transfer rollers are shown in FIG. 11. As shown, for the transfer roller according to the fifth embodiment, the resistivity of resistive layer 1 decreases as the atmospheric vapor pressure increases, and changes from about $1\times10^9\Omega\cdot cm^2$ to about $1\times10^7\Omega\cdot cm^2$ as the atmospheric vapor pressure changes from 10 mb to 40 mb. On the contrary, the compared example shows an almost constant resistivity with respect to the atmospheric vapor pressure.

Figure 5:
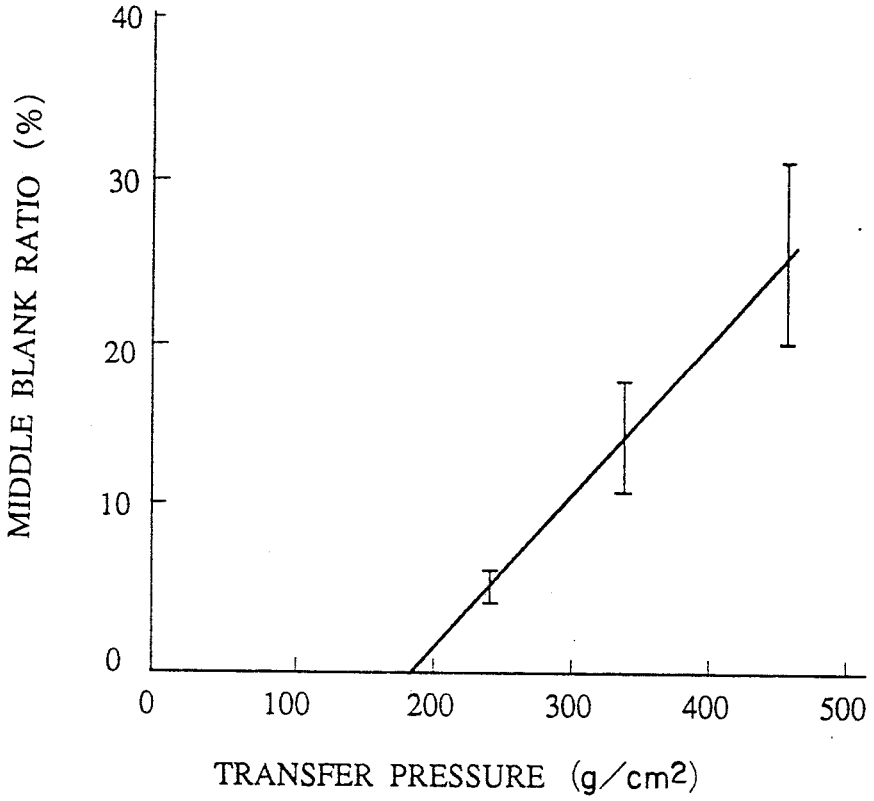
FIG. 5 is a graph of the probability of appearance of middle blanking versus the transfer pressure for the transfer device of FIG. 3.

The same relationship between the probability for occurrence of middle blank and the transfer pressure for the transfer device for the first embodiment shown in FIG. 5 above can be obtained by using the fifth embodiment of the transfer roller.

Figure 12:
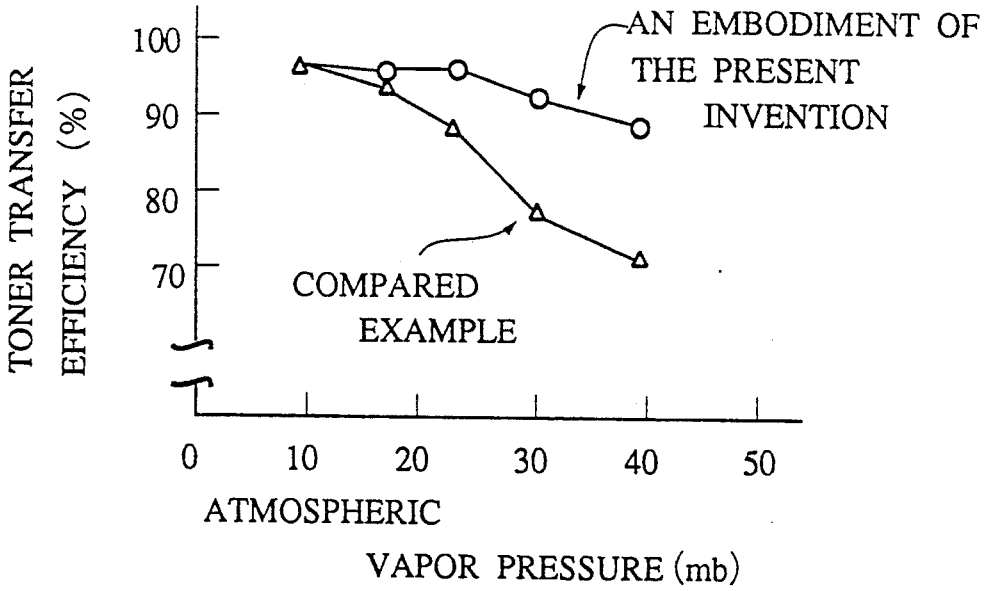
FIG. 12 is a graph of the toner transfer efficiency versus the vapor pressure of the atmosphere for the transfer device using the fifth embodiment of the transfer roller.

Next, the relationship between the atmospheric vapor pressure and the toner transfer efficiency for the transfer device using the fifth embodiment of the transfer roller as well as for that using the transfer roller largely independent of the environmental humidity as a comparison were measured, the result of which is shown in FIG. 12 for four different atmospheric vapor pressures. In FIG. 12, the toner transfer efficiency is represented by a ratio of an amount of the toner transferred to the receiving paper 9 with respect to the sum of that amount and an amount of the toner left on the photoconductive drum 7. As shown in FIG. 12, the transfer device using the fifth embodiment of the transfer roller is capable of maintaining over 80% of the toner transfer efficiency for a wide range of atmospheric vapor pressure (corresponding to conditions between 10° C., 25% humidity and 40° C., 90% humidity), whereas the compared example of the transfer roller is largely independent of the environmental humidity, the toner transfer efficiency dropped below 80% as the atmospheric vapor pressure was increased. Since it is practically satisfactory when the toner transfer efficiency is above 80%, the result shown in FIG. 12 makes the clear distinction of the fifth embodiment of a transfer roller.

This difference between the transfer device using the fifth embodiment of the transfer roller and that using the transfer roller largely independent of the environmental humidity can be explained as follows.

Figure 13:
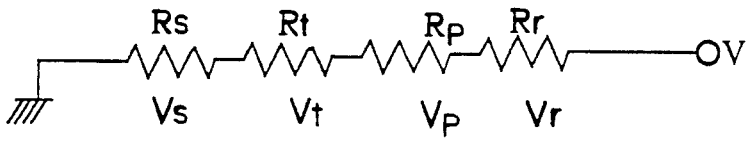
FIG. 13 is a model circuit diagram for explaining the effect of the fifth embodiment of the transfer roller.

The process of toner transfer can be considered electrically as being represented by a simple model in which the photoconductive drum, the toner layer, the receiving paper, and the transfer roller can be represented by respective resistances $R_s$, $R_t$, $R_p$, and $R_r$ in series, as shown in FIG. 13. In this model, the transfer bias voltage V is divided up into $V_s$, $V_t$, $V_p$, and $V_r$ by the resistances $R_s$, $R_t$, $R_p$, $R_r$. Now, in order for the toner layer to be transferred from the photoconductive drum to the receiving paper, enough voltage to overcome the electrostatic attraction between the toner layer and the photoconductive drum must be applied to the toner layer. This voltage to be applied to the toner layer is given by:

$$V_t=[Rt/(Rs+Rt+Rp+Rr)]V \quad (1)$$

Among quantities involved in equation (1), the resistance corresponding to the receiving paper $R_p$ can be changed easily. In particular, when the receiving paper, is hygroscopic paper this resistance $R_p$ can drop down to order of $10^6\Omega\cdot$cm as the atmospheric vapor pressure increases. In addition, the resistance $R_t$, corresponding to that of the toner itself, can also be affected by the atmospheric vapor pressure, although to a lesser extent than the receiving paper. Thus, for the transfer roller largely independent of environmental humidity, with low atmospheric vapor pressure, the resistance Rt of the toner layer can remain higher than the resistance Rr of the transfer roller. Therefore, the voltage $V_t$ on the toner layer can be sufficiently high, but with increases of the atmospheric vapor pressure the resistance Rt of the toner decreases while the resistance of the transfer roller stays the same so that the resistance Rt of the toner can no longer be higher than the resistance Rr of the transfer roller. Consequently, the voltage Vt as well as the toner transfer efficiency decreases. On the other hand, for the transfer device using the fifth embodiment of the transfer roller, as this transfer roller has the resistivity which decreases as the atmospheric vapor pressure increases, the resistance Rr of the transfer roller decreases along with decreases of resistance Rt of the toner. Thus, voltage Vt and consequently the toner transfer efficiency are largely unaffected by the change in the atmospheric vapor pressure. In other words, in the transfer device using the fifth embodiment of the transfer roller, the change in the resistivity of the toner due to the charge in the atmospheric pressure is effectively compensated by the change in the resistivity of the transfer roller such that the toner transfer efficiency remains unaffected. Obviously, the resistances in the above argument can be replaced by the volume resistivity. In this regard, it is noted that when the resistivity per unit area of the resistive layer 1 of the transfer roller becomes less than $1\times10^7\Omega\cdot cm^2$, there appears a charge injection from the transfer roller to the receiving paper, causing the charge flow into the toner which produces toner of the inverse polarity, resulting in the decrease of the toner transfer efficiency. It is also noted that when the resistivity per unit area of the resistive layer 1 of the transfer roller becomes more than $1\times10^{10}\Omega\cdot cm^2$, the voltage Vr applied to the transfer roller becomes too large, and the voltage Vt applied to the toner becomes too small, such that toner transfer efficiency decreases.

Figure 14:
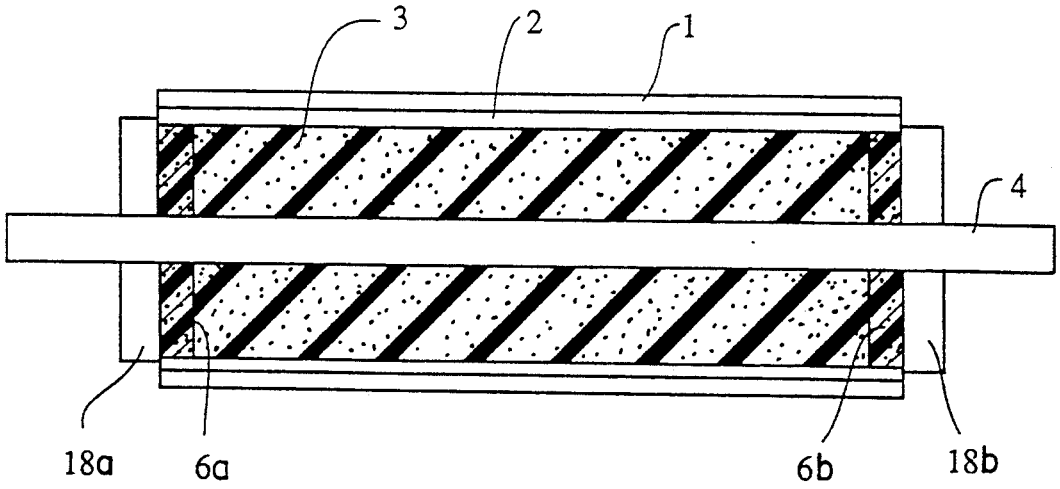
FIG. 14 is a longitudinal sectional view of sixth embodiment of the transfer roller to be incorporated in the electrophotographic printing apparatus according to the present invention.

As an sixth embodiment of the transfer roller, FIG. 14 shows a transfer roller in which the first embodiment of the transfer roller of FIG. 3 is equipped with guiding rings 18*a* and 18*b* at the side edges. Each of these guiding rings 18*a* and 18*b* has a radius smaller than that of the transfer roller itself by about 300 μm, and is made of incompressible insulator such as terlinguaite. The rest of this sixth embodiment of FIG. 14 is substantially identical to the first embodiment of FIG. 3.

A toner transfer device using the transfer roller of FIG. 14 will now be explained.

In this transfer device, a receiving paper 9 is to be carried in between the transfer roller 5 and an photoconductive drum 7 conveying an electrostatic latent toner image 8. As the photoconductive drum 7 rotates in a direction indicated by an arrow, the toner image 8 on the photoconductive drum 7 is brought into a transfer area between points B and C, and makes contact with the receiving paper 9 there. At this point, there is a transfer bias voltage with a polarity opposite that of the toner charges applied from a high voltage generator 10 to the toner image 8. The toner image 8 is electrostatically transferred to the receiving paper 9 and forms an image 11 on the receiving paper 9. The transfer bias voltage is required to be approximately 2 kV for a normal imaging in which the image is formed by the toner which has the polarity opposite to that of the toner charges on the photoconductive drum 7 attached on the charged portion of the photoconductive drum 7, and approximately 1 kV for reverse imaging in which the image is formed by the toner which has the polarity equal to that of the toner charges on the photoconductive drum 7 attached on the uncharged portion of the photoconductive drum 7. At the transfer area between the points B and C, the photoconductive drum 7 and the receiving paper 9 are in contact with a wide and constant nip width because of the elastic deformation of the elastic sponge rubber 3 and the guiding rings 18*a* and 18*b* which have diameters smaller than that of the transfer roller. The flexible structure of the elastic sponge rubber 3 also maintains the constantly low transfer pressure in this transfer area as well. Also, a uniform transfer condition is obtainable over the entire range of mechanical conditions.

The same relationship between the probability for occurrence of middle blank and transfer pressure for the transfer device for the first embodiment shown in FIG. 5 above can be obtained by using the sixth embodiment of the transfer roller.

Figure 15:
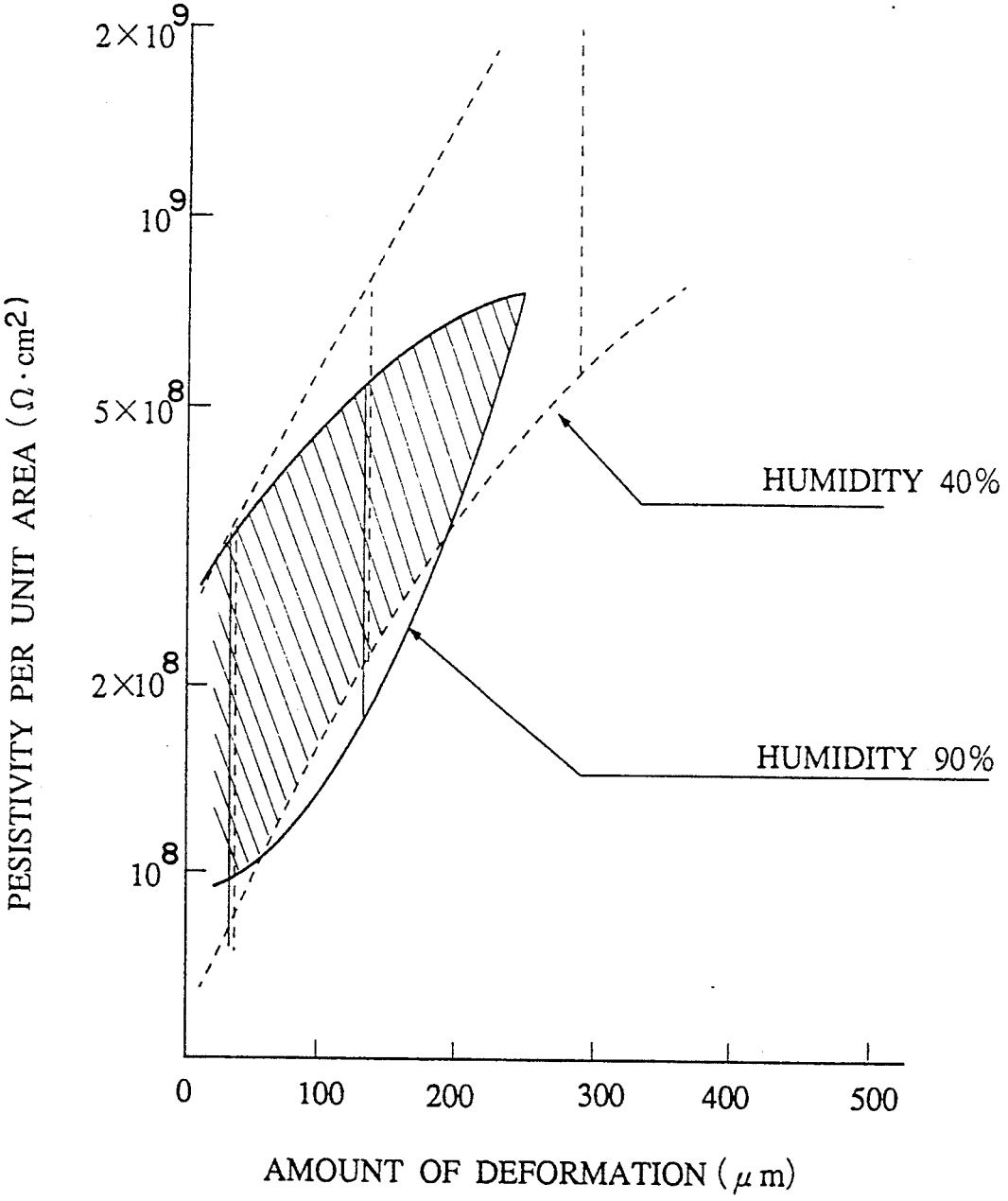
FIG. 15 is a graph of the resistivity per unit area versus the amount of deformation for the transfer device using the transfer roller of FIG. 14, under two different environmental humidity.

The relationship between the amount of deformation of the transfer roller in a direction of its radius and the resistivity per unit area of the transfer roller for the transfer device using the transfer roller of FIG. 14 is shown in FIG. 15 for two different environmental humidities. Here, the amount of deformation of the transfer roller in the direction of its radius is given by subtracting the radius of the guiding rings from the sum of the radius of the transfer roller and the thickness of the receiving paper. In FIG. 15, a region in which the toner transfer efficiency becomes higher than 90% is shown as shaded, whereas before the toner transfer efficiency was represented by the ratio of an amount of the toner transferred to the receiving paper 9 with respect to a sum of that amount and an amount of the toner left on the photoconductive drum 7.

As before, the resistive resin sheets of the resistive layer 1 can be designed solely from the point of view regarding its electrical characteristics. The inadequately small resistivity results in a severe decrease in the toner transfer efficiency due to the spark discharge between the resistive layer 1 and the photoconductive drum 7 when the transfer bias voltage is applied, or production of the inverse toner transfer is caused by charge injection from the receiving paper 9 to the toner image 8. On the other hand, excessive volume resistivity also results in the decrease of toner transfer efficiency due to dropping of the transfer bias voltage distributed to the toner layer itself. Thus, for the transfer device using the transfer roller of FIG. 14, the resistivity per unit area within a range of $1\times10^{7}$–$1\times10^{10}\Omega\cdot cm^2$ is suitable and, in particular, that in a range of $1\times10^{8}$–$5\times10^{8}\Omega\cdot cm^2$ is preferable. As shown in FIG. 15, with the resistivity per unit area within this preferable range the toner transfer efficiency higher than 90% is obtainable by the transfer device using the transfer roller of FIG. 14 even with the environmental humidity of over 90% RH.

The change in the amount of deformation of the transfer roller also causes increase in the nip width which determines the time of contact between the photoconductive drum 7, the receiving paper 9 and the transfer roller, i.e., the transfer time. FIG. 15 shows values of the amount of deformation and the resistivity per unit area of the transfer roller which give the toner transfer efficiency of over 90% when the photoconductive drum moves at a speed of 100 mm/sec. The amount of deformation is preferably less than 300 μm, and more preferably less than 150 μm. For this reason, it is desirable for the guiding rings 18*a* and 18*b* to have the radius less than that of the transfer roller by not more than 300 μm. When the speed of the photoconductive drum is increased, the transfer time corresponding to the same nip width is shortened, and the allowed amount of deformation an increases in. However, increase the speed of the photoconductive drum also increases the possibility for the middle blank, so the aforementioned range for the allowed amount of deformation is more desirable.

The guiding rings 18*a* and 18*b* made of a hard insulator are preferably placed such that it makes contact with the peripheral region of the photoconductive drum 7, so as not to damage the image forming region of the photoconductive drum 7. The guiding rings 18*a* and 18*b* may be covered with soft rubber in order to increase friction between the photoconductive drum 7 and the guiding rings 18*a* and 18*b*, for assisting the rotation of the transfer roller.

Figure 16:
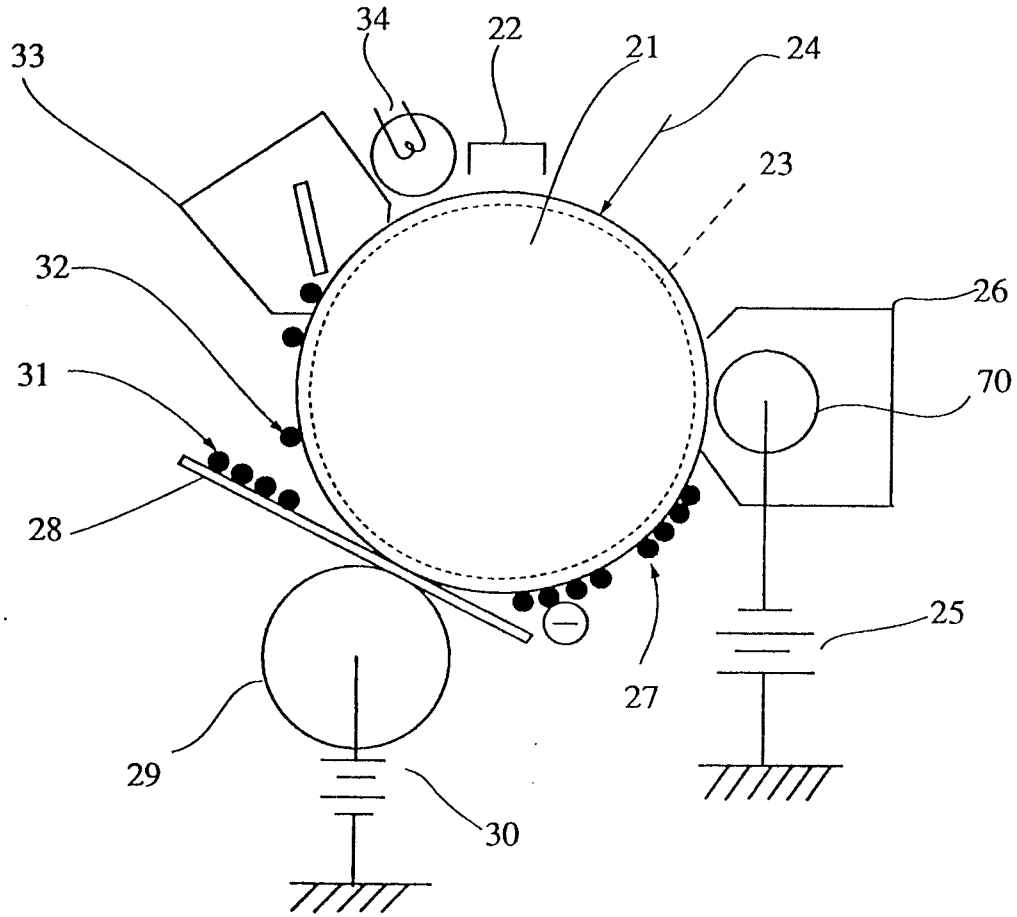
FIG. 16 is a schematic diagram of one embodiment of an electrophotographic printing apparatus according to the present invention.

Referring now to FIG. 16, the electrophotographic printing apparatus with the transfer device using the transfer roller of the present invention will be explained. Here, in principle, the transfer roller can be any of the various embodiments described above.

FIG. 16 shows an electrophotographic printing apparatus with a reverse developing device. In this apparatus, negative charges 23 are generated on a photoconductive drum 21 by a charger 22. This photoconductive drum 21 with negative charges 23 is then illuminated by light signals 24, such as laser beams, so as to have a reversed electrostatic latent image formed thereon. This electrostatic latent image is developed by a developing device 26, so as to have a visible image 27 formed on the photoconductive drum 21. The developing device 26 possesses a developing roller 70 biased by a bias voltage source 25 with a negative bias voltage of approximately 600 V, which is approximately equal to the surface potential of the photoconductive drum 21. The negative polarity toner contained in the developing device 26 is also biased by the same voltage through the developing roller 70. This visible image 27 is then transferred to a receiving paper 28 which is conveyed between the photoconductive drum 21 and a transfer roller 29 which has a positive voltage of approximately 2 kV applied from a transfer bias voltage source 20, so as to have a toner image 31 formed on the receiving paper 28. The residual toner 32, left over on the photoconductive drum 21, is cleaned out by the cleaning device 33, and the negative charge 23 on the photoconductive drum 21 is cleared by lamp 34, before returning to the charger 22 to repeat the process.

Figure 17:
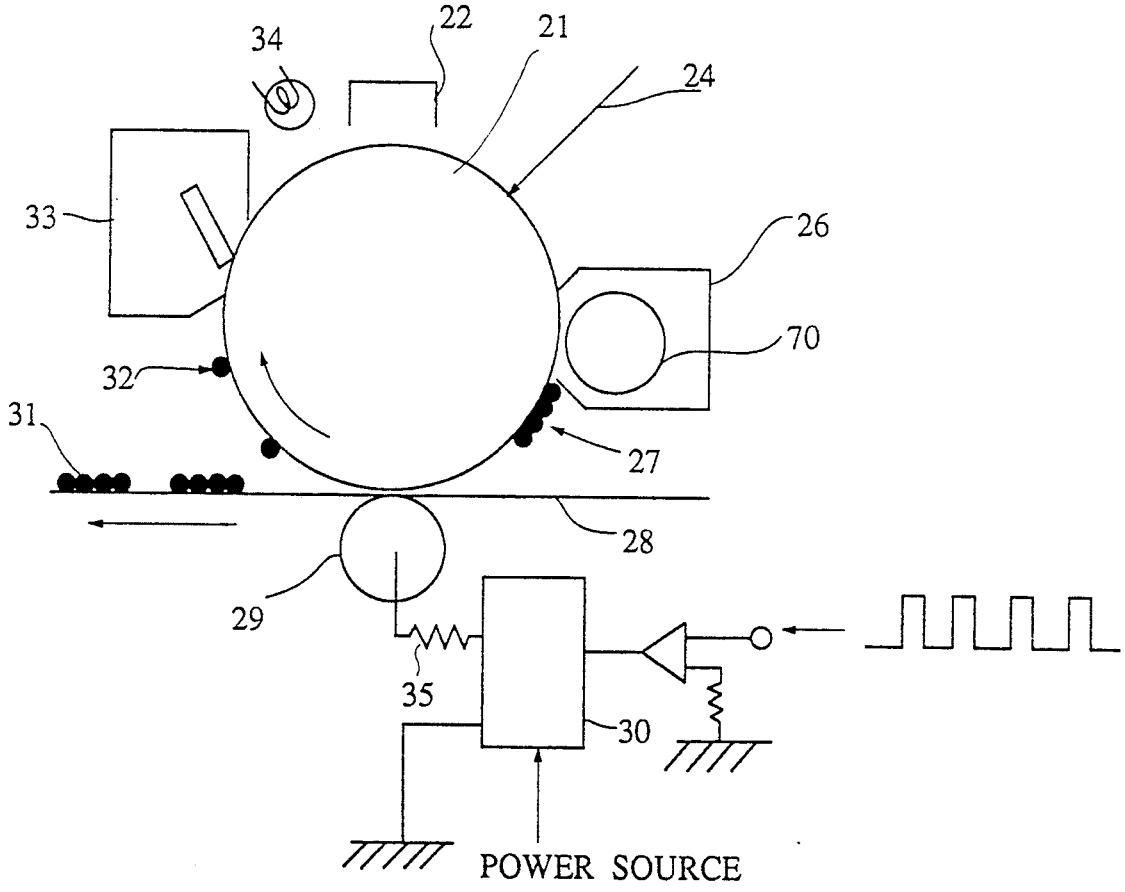
FIG. 17 is another schematic diagram of the electrophotographic printing apparatus of FIG. 16 for explaining the transfer bias voltage to be used in this embodiment.

In this electrophotographic printing apparatus, the application of the transfer bias voltage is preferably done in pulsed form, as shown in FIG. 17.

For the transfer roller 29 with a nip width of about 2 mm the transfer time is approximately 0.02 sec at a process speed of 100 mm/sec. For such a transfer roller 29 the transfer bias voltage in pulsed form with a pulse width 0.005 sec and the period 0.01 sec is suitable. This pulse period is determined such that there is no accumulation of charges on either the receiving paper 28 or the transfer roller 29.

Figure 18:
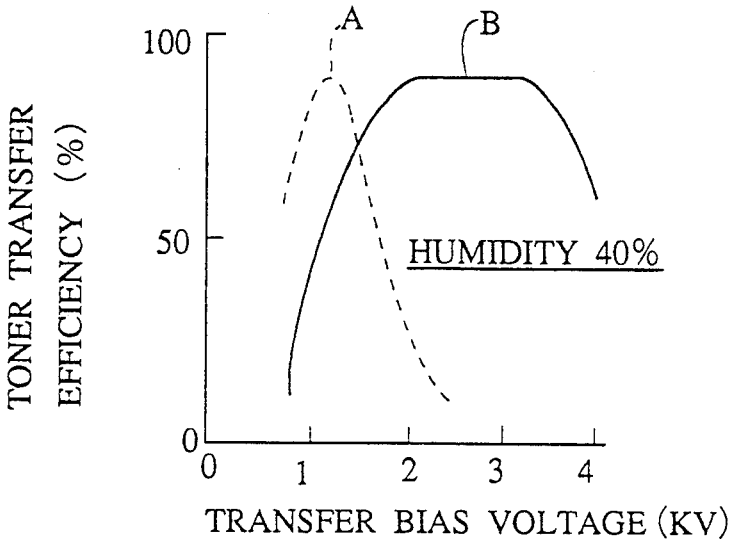
FIGS. 18(A) and (B) are graphs of the amount of the toner transferred versus the transfer bias voltage under different environmental humidities, for the apparatus of FIG. 17 and for a conventional printing apparatus.
Figure 18:
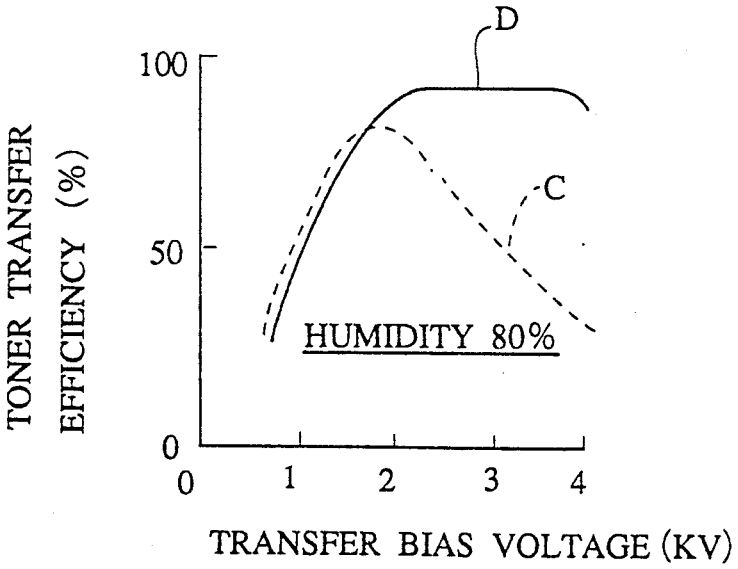

The relationship between the amount of toner transferred and the absolute value of the transfer bias voltage of both pulsed and non-pulsed types are plotted in FIGS. 18(A) and 18(B) for an environmental humidity of 40% RH and 80% RH, respectively.

In case of 40% RH environmental humidity shown in FIG. 18(A), the non-pulsed transfer bias voltage represented by a curve A shows the toner transfer efficiency reaches the maximum value of 90% at the transfer bias voltage of absolute value about 1.2 kV, and the toner transfer efficiency sharply drops around this maximum. On the other hand, the pulsed transfer bias voltage represented by a curve B shows the toner transfer efficiency reaches the maximum value of 90% over an extended range between 2 kV and 3 kV.

In case of 80% RH environmental humidity shown in FIG. 18(B) in which both the toner as well as the receiving paper 28 are moistened, the non-pulsed transfer bias voltage represented by a curve C shows the toner transfer efficiency reaches the somewhat smaller maximum value of 80% at the transfer bias voltage of absolute value about 1.8 kV, which differs from the case of 40% RH environmental humidity. On the other hand, the pulsed transfer bias voltage represented by a curve D shows that the toner transfer efficiency reaches an maximum value of 90% over an extended range between 2 kV and 3.5 kV.

Thus, with a pulsed transfer bias voltage, not only can the maximum amount of toner transferred be maintained between two different environmental humidities, but this maximum can be obtained for the transfer bias voltage of the same absolute values, so that the stability of the toner transfer can be greatly improved.

Moreover, this transfer roller 29 has a resistivity per unit area of roughly $10^{8}\ \Omega\cdot cm^2$, but this value of the resistivity per unit area can vary between $10^{7}\ \Omega\cdot cm^2$ and $10^{8}\ \Omega\cdot cm^2$ in the manufacturing process. For this reason the transfer bias voltage source 30 is equipped with a variable resistor 35 as a protection, and in this respect the use of the pulsed transfer bias voltage has an added advantage of being able to make the protection adaptable to a wider range of variation in the surface resistivity than the non-pulsed transfer bias voltage.

It is to be noted that the improved toner transfer efficiency and its stability against the environmental conditions by the use of the pulsed transfer bias voltage is achievable primarily because with the pulsed transfer bias voltage the time for the inverse charges from the receiving paper 28 to be injected into the toner can be eliminated, so that the inverse transfer of the toner can be prevented. From this point of view, the transfer bias voltage may also be obtained as an AC voltage biased by a DC voltage instead of the strictly pulsed one like that shown in FIG. 17.

Now, in the electrophotographic printing apparatus of FIG. 16, the toner of a part of the visible image 27 outside the size of the receiving paper 28 will be transferred directly onto the transfer roller 29 itself and contaminate the transfer roller 29. Also, with any mistake in conveying the receiving paper 28, the entire visible image 27 will be transferred directly onto the transfer roller 29. In addition, even under the normal operation, the transfer roller 29 can be contaminated by drifting toner. Such a contamination of the transfer roller 29 by the toner not only causes staining of the backs of receiving paper 28, but the insulative toner on the transfer roller may also contributes to a transfer fluctuation.

The manner of cleaning the contaminated transfer roller 29 will now be explained with references to FIGS. 19 and 20.

Figure 19:
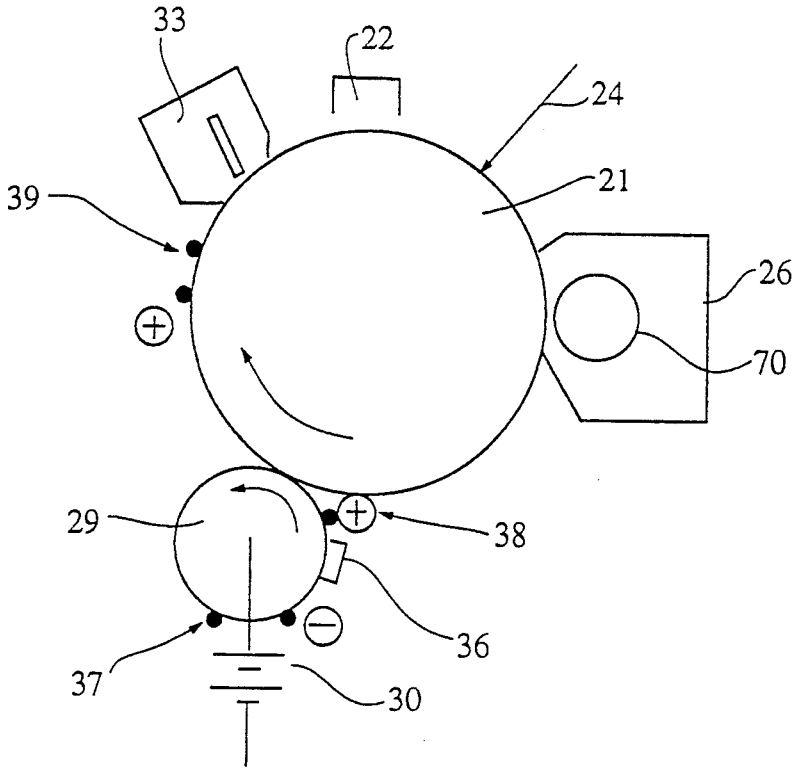
FIG. 19 is another schematic diagram of the electrophotographic printing apparatus of FIG. 16 for explaining the cleaning of the transfer roller in this embodiment.

In an embodiment shown in FIG. 19, a control charger 36 located above the transfer roller 29 applies positive voltage on negatively charged toner 37 sticking on the transfer roller 29. By this control charger 36, the negatively charged toner 37 is turned into positively charged toner 38 as it passes. The positively charged toner 38 is then back-transferred to photoconductive drum 21 by the transfer bias voltage of 600 V applied by the transfer bias voltage source 30. As a result, the positively charged toner 39 appears on the photoconductive drum 21, which is subsequently cleaned by the cleaning device 33 just as the residual toner 31 from the original transferring. Here, the surface potential of the photoconductive drum 21 is preferably less than approximately 100 V.

Such a cleaning of the transfer roller 29 can be done by reserving one rotation of the photoconductive drum 21 following that of the original transferring exclusively for this purpose. The developing device 26 can be deactivated during this process of cleaning the transfer roller 29.

Figure 20:
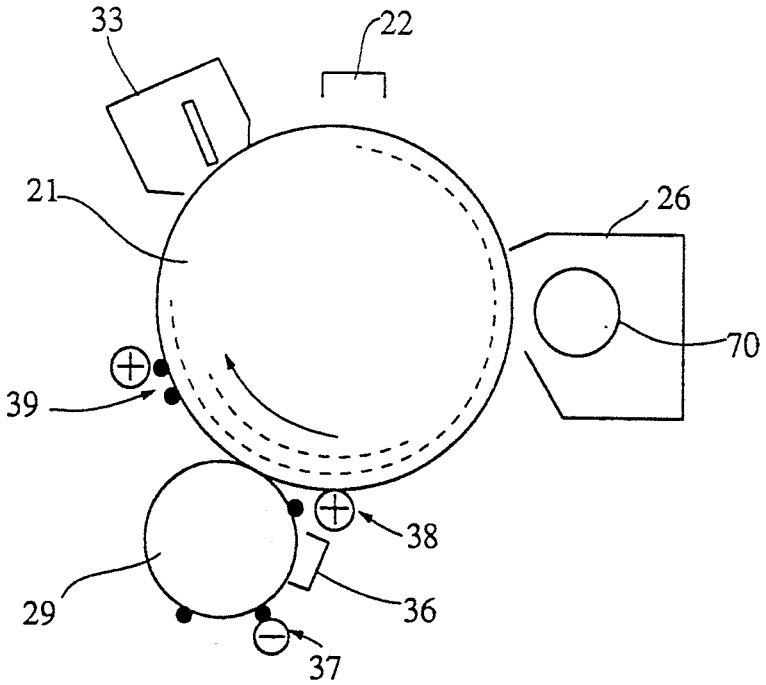
FIG. 20 is another schematic diagram of the electrophotographic printing apparatus of FIG. 16 for explaining the cleaning of the transfer roller in this embodiment.

Alternatively, in another embodiment shown in FIG. 20, there is also provided a control charger 36 located above the transfer roller 29 which applies positive voltage on negatively charged toner 37 sticking on the transfer roller 29. By this control charger 36, the negatively charged toner 37 is turned into positively charged toner 38 as it passes between the rollers. The positively charged toner 38 is then back-transferred to photoconductive drum 21. Here, the back-transferring of the positively charged up toner 38 is accomplished by the surface voltage of the photoconductive drum 21, which is changed to −600 V by the charger 22. Accordingly, in this alternative embodiment of FIG. 20, there is no need for the transfer bias voltage to be applied to the transfer roller 29 in cleaning the transfer roller 29. As in the previous embodiment, the positively charged toner 39 appears on the photoconductive drum 21 as a result, which is subsequently cleaned by the cleaning device 33 just as the residual toner 31 from the original is transferring. As in the previous embodiment, this cleaning of the transfer roller 29 can be done by reserving one rotation of the photoconductive drum 21 following that of the original transferring exclusively for this purpose. The developing device 26 can be de-activated during this process of cleaning the transfer roller 29.

Cleaning of the contaminated transfer roller 29 can also be accomplished by using a cleaning blade for this purpose. This manner of cleaning will now be explained with reference to FIG. 21.

Figure 21:
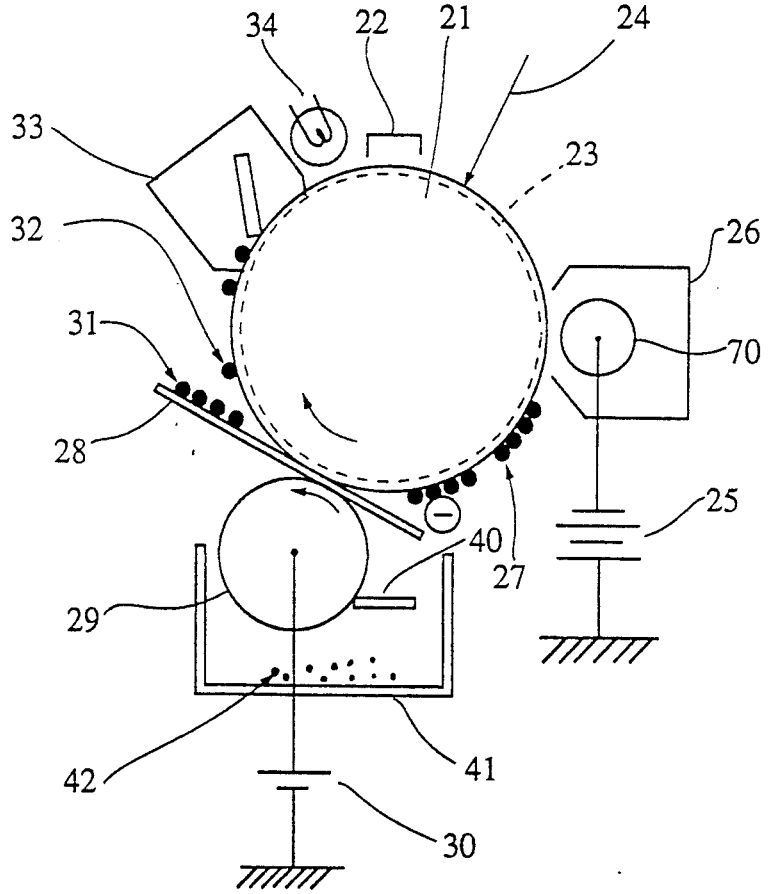
FIG. 21 is another schematic diagram of the electrophotographic printing apparatus of FIG. 16 for explaining the alternative manner of cleaning the transfer roller in this embodiment.

In FIG. 21, the electrophotographic printing apparatus of FIG. 16 is further equipped with a transfer roller cleaning blade 40 attached to the transfer roller 29, and a excess toner container 41 for collecting excess toner 42 cleaned off from the transfer roller 29 by the transfer roller cleaning blade 40.

The transfer roller cleaning blade 40 can be made of various rubber material, such as polyurethane rubber, nitrile rubber, and ethylene propylene rubber, or plastics, such as polyethylene and of polycarbonate. The blade contact pressure of the transfer roller cleaning blade 40 is preferably within a range of 100–400 g/20 cm, and more desirably within a range of 150–300 g/20 cm. Too little a blade contact pressure results in insufficient cleaning, whereas too large a blade contact pressure obstructs the rotation of the transfer roller 29 and also causes damage on the transfer roller 29. Also, in relation to this, the transfer roller should not have, on its surface, a concavity deeper than 150 μm, and more desirably not deeper than 120 μm, in order to facilitate effective cleaning.

Regarding this transfer roller cleaning blade 40, further care needs to be taken in its arrangement with respect to the transfer roller.

Figure 22:
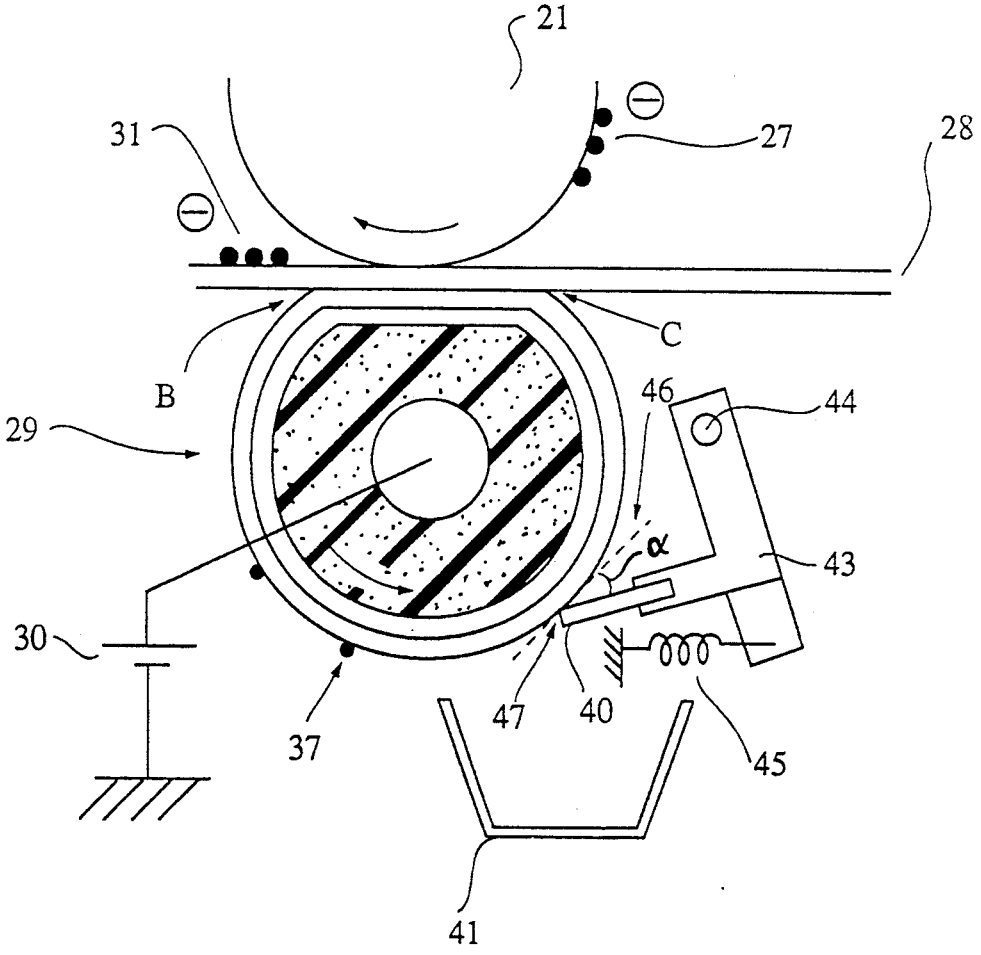
FIG. 22 is another schematic diagram of the electrophotographic printing apparatus of FIG. 21 for explaining the transfer roller cleaning blade in this embodiment.

In FIG. 22, an example of detail configuration and its arrangement of the transfer roller cleaning blade 40 is shown in relation to the transfer roller 29. In this example, the transfer roller cleaning blade 40 is supported by a supporting member 43 which is pivotal around a pivot point 44, and which brings the transfer roller cleaning blade 40 into contact with the transfer roller 29 under the pulling force exerted by a spring member 45. The transfer roller cleaning blade 40 is held such that a tangent line 46 of the transfer roller 29 at a contact point 47 of the transfer roller cleaning blade 40 and the transfer roller 29 makes an acute angle $\alpha$ with the transfer roller cleaning blade 40. In addition, the pivot point 44 of the supporting member 43 is arranged to be located on the transfer roller side of the tangent line 46. The transfer pressure of the transfer roller 29 on photoconductive drum 21 is set to be less than 200 g/cm$^2$ in accordance with the nip width of approximately 2 mm, so that the line pressure is 40 g/cm. The blade contact pressure between the transfer roller 29 and the transfer roller cleaning blade 40 is set to be about 15 g/cm. This blade contact pressure is sufficiently small when it is less than the transfer pressure by more than 5 g/cm, as far as the motion of the transfer roller 29 is concerned.

Figure 23:
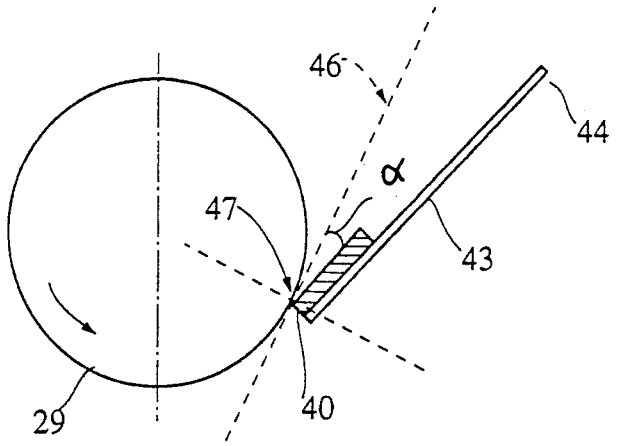
FIGS. 23(A), (B), and (C) are diagrammatic illustrations of the transfer roller and the transfer roller cleaning blade in the apparatus of FIG. 21 for explaining the care to be taken in arranging the transfer roller cleaning blade.
Figure 23:
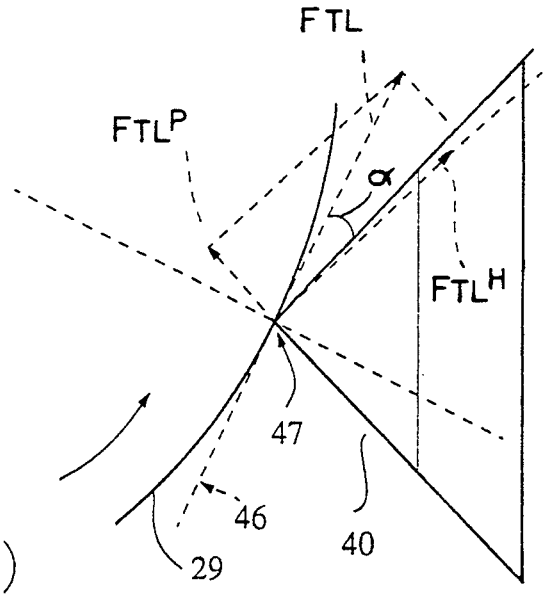
Figure 23:
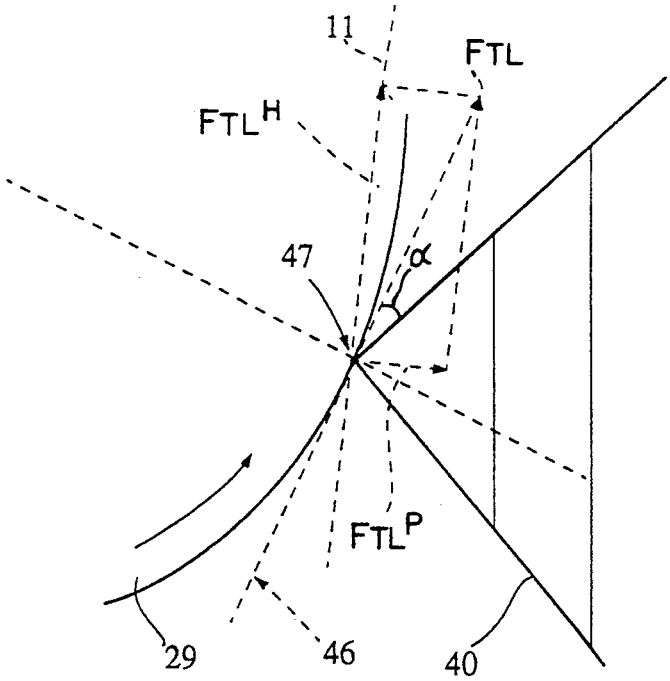

Referring now to FIGS. 23(A), (B), and (C), the reason for this particular arrangement of the transfer roller cleaning blade 40 will be explained.

FIG. 23(A) shows a situation opposite to the arrangement described above such that the pivot point 44 of the supporting member 43 is arranged to be located to the opposite side of the transfer roller side of the tangent line 46. In this case, a diagram for the force exerted by the transfer roller cleaning blade 40 on the transfer roller 29 is shown in FIG. 23(B). As shown in FIG. 23(B), a force $F_{TL}$ along the tangent line 46 has a component $F_{LT}^H$ in a direction from the contact point 47 to the pivot point 44 and another component $F_{LT}^P$ in a direction perpendicular to that from the contact point 47 to the pivot point toward the transfer roller 29. Thus, this latter component $F_{LT}^P$ acts to bore the transfer roller cleaning blade 40 into the transfer roller 29, which could not only hamper the motion of the transfer roller 29 but also damage the transfer roller 29 resulting in insufficient transferring and cleaning.

Figure 1:
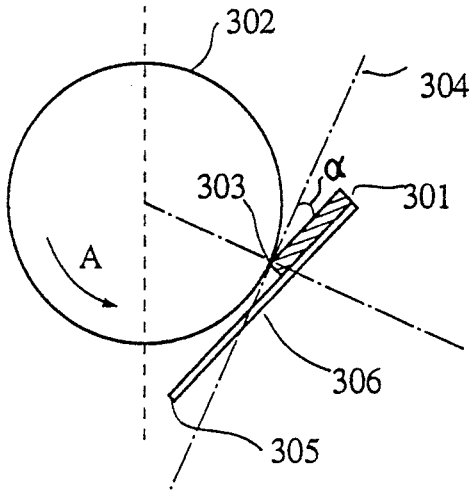
FIG.1 PRIOR ART
FIG. 1 is schematic diagram of a conventional cleaning blade for the transfer roller.
Figure 2:
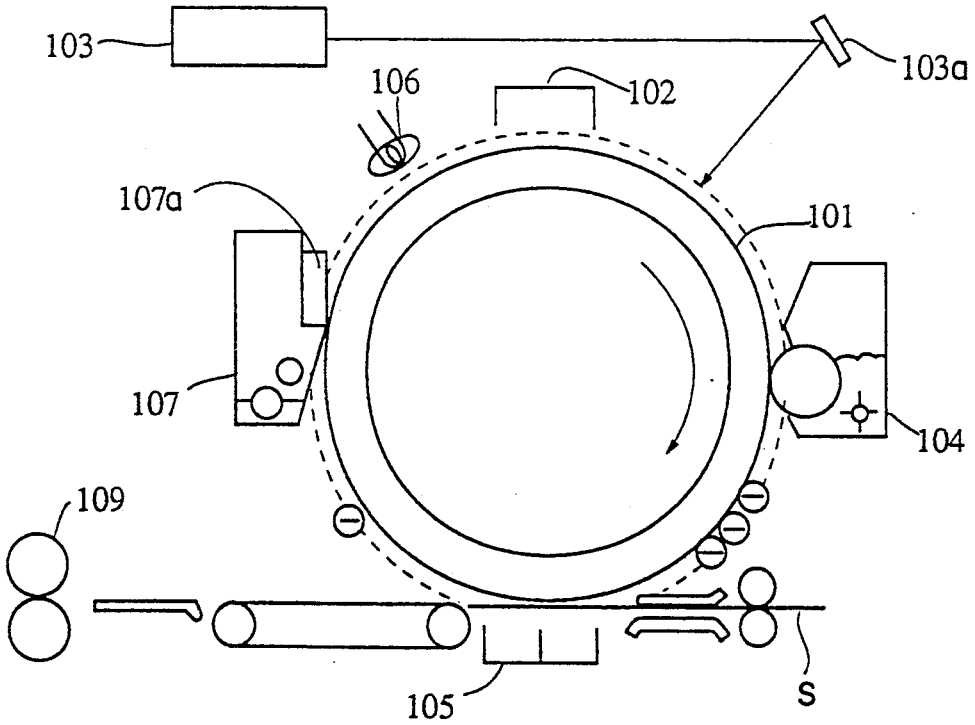
FIG.2 PRIOR ART
FIG. 2 is a schematic diagram of a conventional laser printer.

On the contrary, for the arrangement described above in which the pivot point 44 of the supporting member 43 is arranged to be located in the transfer roller side of the tangent line 46, a diagram for the force exerted by the transfer roller cleaning blade 40 on the transfer roller 29 is shown in FIG. 23(C). As shown in FIG. 23(C), a force $F_{TL}$ along the tangent line 46 has a component $F_{TL}^H$ in a direction from the contact point 47 to the pivot point 44 and another component $F_{TL}^P$ in a direction perpendicular to that from the contact point 47 to the pivot point away from the transfer roller 29. Thus, the boring in of the transfer roller cleaning blade 40 is prevented because of the latter component $F_{TL}^P$ constantly acts to push the transfer roller cleaning blade 40 up in this case. Here, sufficient cleaning ability is also provided by the acute angle $\alpha$ between the tangent line 46 and the transfer roller cleaning blade 40. As a result, the balance between the component $F_{TL}^P$ and the external force exerted by the spring member 45 can provide a stable cleaning ability of the transfer roller cleaning blade 40. It is obvious from the foregoing explanation that the position of the pivot point 44 with respect to the point of contact 47 is irrelevant so that a counter-configuration like one shown in FIG. 1 for the background art can be equally satisfactory as long as the above conditions concerning the position of the pivot point 44 with respect to the tangent line 46 and the angle $\alpha$ between the tangent line 46 and the transfer roller cleaning blade 40 are satisfied.

Figure 24:
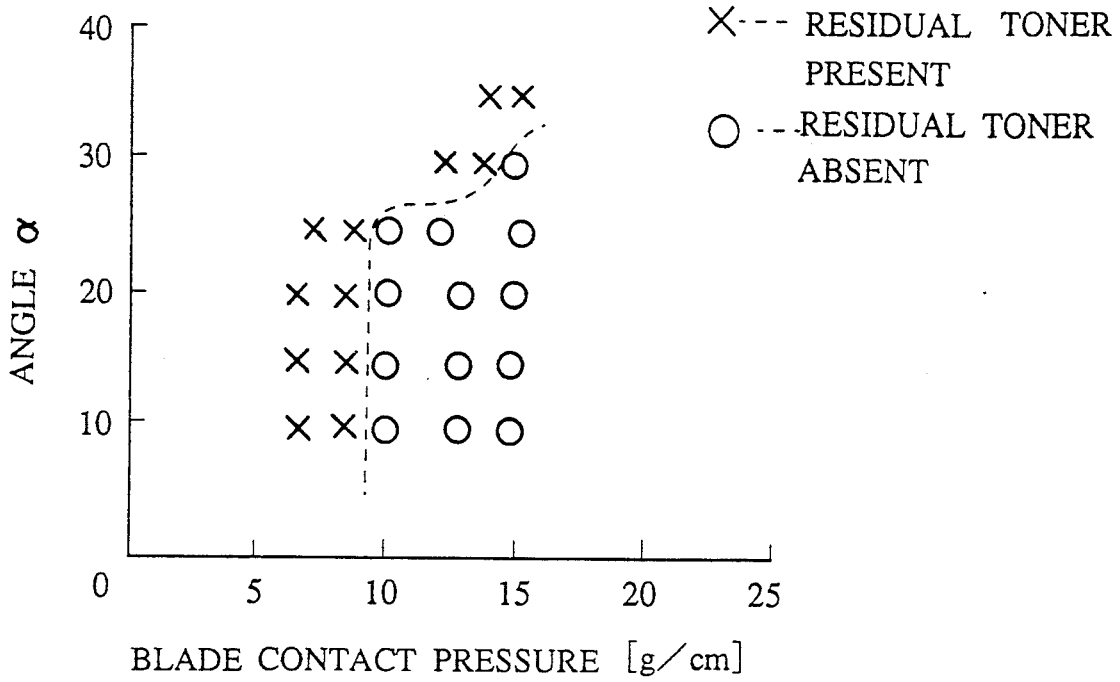
FIG. 24 is a graph of the the angle between the tangent line of the transfer roller and the transfer roller cleaning blade versus the contact pressure between the transfer roller cleaning blade on the transfer roller for the apparatus of FIG. 21.

FIG. 24 shows a relationship between the angle $\alpha$ between the tangent line 46 and the transfer roller cleaning blade 40 and the blade contact pressure between the transfer roller cleaning blade 40 on the transfer roller 29. As shown, an angle $\alpha$ of less than 30° and a blade contact pressure of more than 10 g/cm is more satisfactory. This blade contact pressure should, in any case, be less than 500 g/cm, in order to avoid permanent deformation of the transfer roller 29. Furthermore, when the transfer pressure between the photoconductive drum 21 and the transfer roller 29 is set to be less than 200 g/cm$^2$ or equivalently 40 g/cm, and still the transfer roller 29 is to be rotated as a reaction to the rotation of the photoconductive drum 21, the blade contact pressure needs to be less than 35 g/cm. Consequently, the most desirable value of the blade contact pressure is within a range of 10–35 g/cm.

Figure 25:
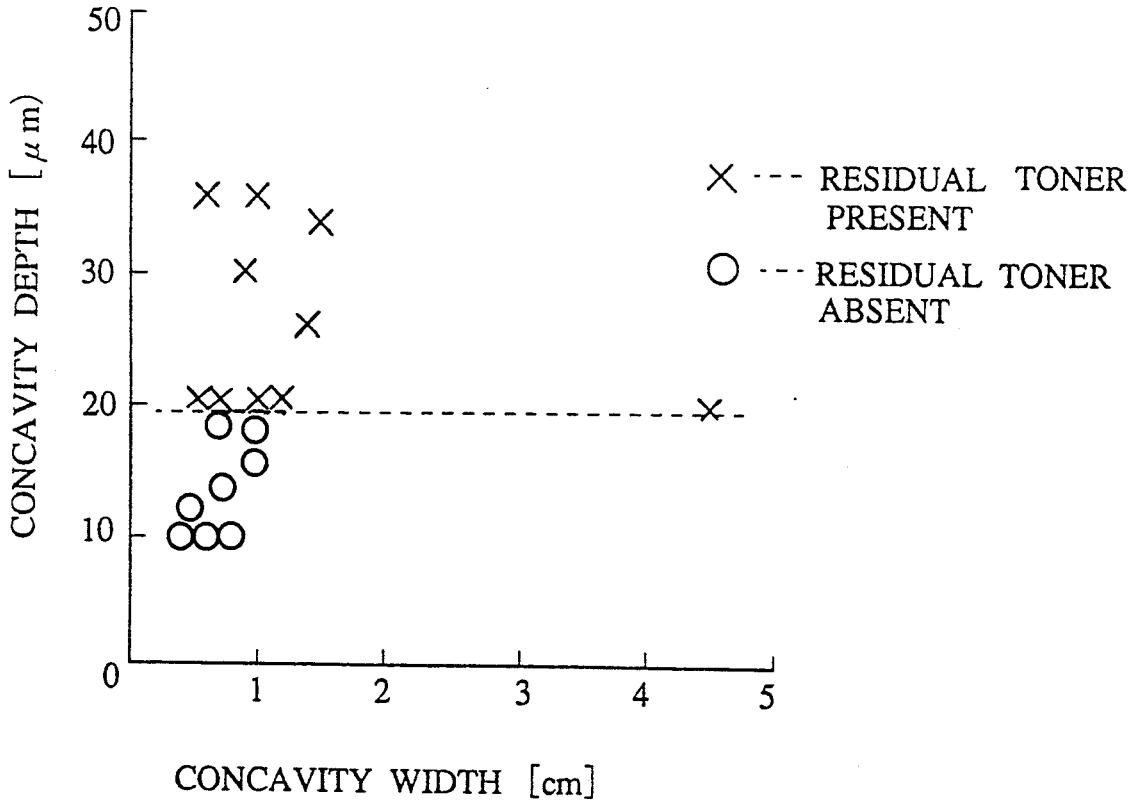
FIG. 25 is a graph showing the the effectiveness of the cleaning by the transfer roller cleaning blade for the waving of different depth and width on the transfer roller in the apparatus of FIG. 21.

In addition, the transfer roller 29 may have concavities on its surface in which the toner can pile up because it cannot be cleaned well. Such a concavity is either a roughness of the surface layer, or else a waving of 2–3 mm wavelength arising when the surface layer is placed over an elastic body. As for the concavity due to the roughness of the surface layer, its depth is preferably less than a typical size of the toner particle, which is usually about 12 $\mu$m. Thus, the depth of this type of concavity is preferably less than 5 $\mu$m, since there is only about 5% of the toner particle with size 5 $\mu$m, so that the contamination of the transfer roller 29 by such small percent of the toner is negligible. As for concavity due to waving, the effectiveness of the cleaning by the transfer roller cleaning blade 40 is shown for the waving of different depths and widths in FIG. 25. As shown in FIG. 25, the depth is preferably less than 20 $\mu$m in order for the sufficient cleaning by the transfer roller cleaning blade 40. FIG. 25 also shows that the width of the waving has little effect on the cleaning ability by the transfer roller cleaning blade 40.

As already mentioned in the description of the background art, it is desirable to minimize the amount of excess toner to be collected and discarded. Such a reduction of the excess toner can be accomplished as follows.

Figure 26:
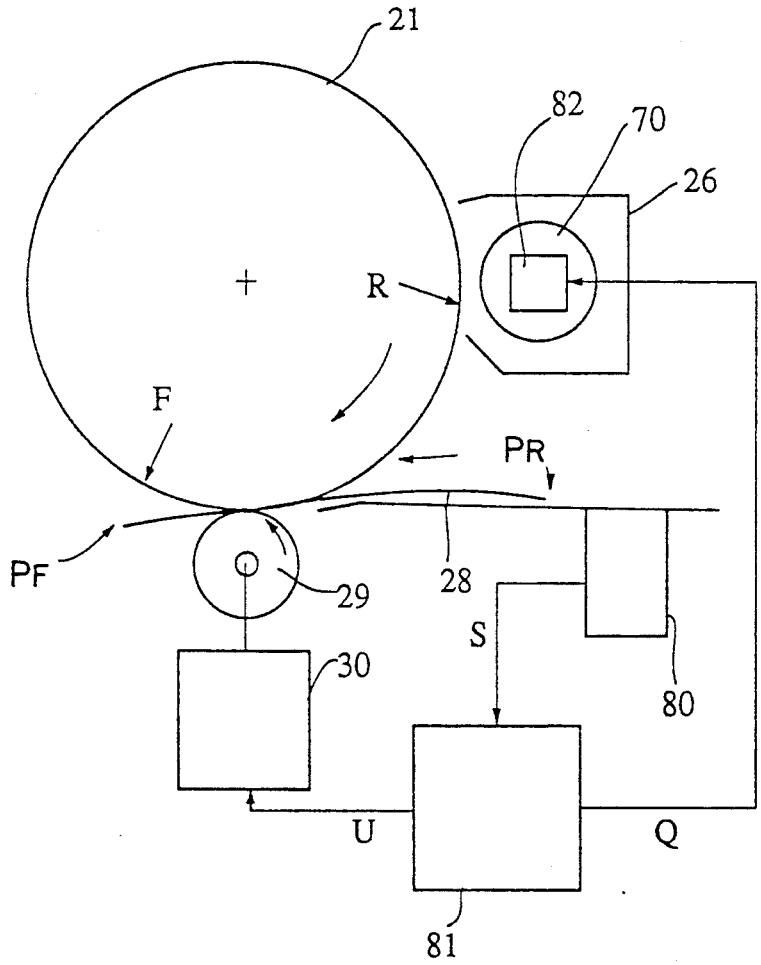
FIG. 26 is a schematic diagram of the apparatus of FIG. 16 for explaining the manner to reduce the excess toner in this apparatus.

FIG. 26 shows relevant parts of the electrophotographic printing apparatus capable of such reduction of the excess toner. Here, there is provided a sensor 80 which detects a front edge $P_F$ and the rear edge $P_R$ of the receiving paper 28 as it is conveyed between the photoconductive drum 21 and the transfer roller 29. The sensor 80 by sensor signals S notifies a microcomputer 81 about these detections. Microcomputer 81 possesses a toner supply control program, which controls a toner supply control unit 82 of the developing roller 70 by toner control signals Q, in accordance with the sensor signals S. The microcomputer 81 also controls the transfer bias voltage source 30 by transfer control signals U. On the photoconductive drum 21, marks F and R indicate the top and bottom of the portion to be developed, which corresponds to the front edge $P_F$ and the rear edge $P_R$ of the receiving paper 28, respectively.

Usually, the size of the receiving paper 28 is detected by a detecting device on a paper tray and the movement is determined by signals from a paper supply roller. However, for receiving paper 28 of non-custom size to be dealt with, sensor 80 is necessary.

Figure 27:
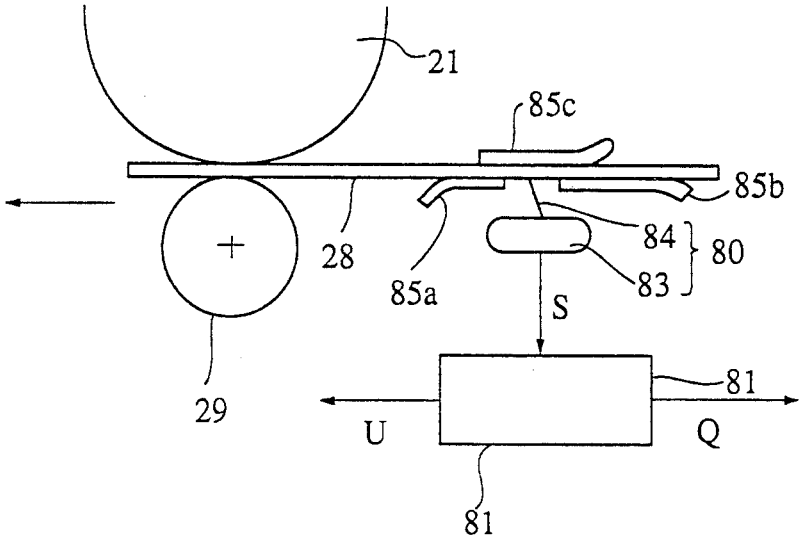
FIGS. 27(A) and (B) are partial schematic diagrams of the apparatus of FIG. 16 for explaining operation by two possible embodiments of the sensor to be utilized in this apparatus.
Figure 27:
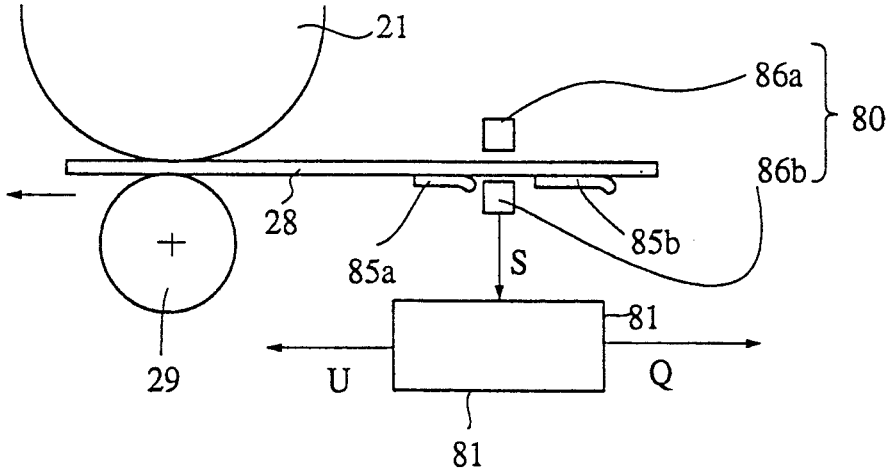

FIG. 27(A) shows one embodiment of the sensor 80 utilizing a micro-switch 83 for producing sensor signals S which is turned on and off by an actuator 84 to be pushed down when the front edge $P_F$ is fed through guides 85*a*, 85*b*, and 85*c*, and to be released when the rear edge $P_R$ passes through.

FIG. 27(B) shows another possible embodiment of the sensor 80 utilizing a LED device 86*a* for emitting light and a photodiode imaging device 86*b* for receiving light from the LED device 86*a*, where the interruption of the light reception by the photodiode imaging device 86*b* due to the passing of the receiving paper 28 along the guides 85*a* and 85*b* causes the photodiode imaging device 86*b* to produce the sensor signals S. Here, the detection by the sensor 80 may be restricted to that of the rear edge $P_R$ alone, leaving the detection of the front edge $P_F$ to a signals from a paper supply roller, when the sensor 80 needs, for design reasons to be located so close to the photoconductive drum 21 that the detection of the front edge $P_F$ by the sensor 80 can only be too late.

The toner supply control unit 82 controls the developing roller 70 as follows.

Figure 28:
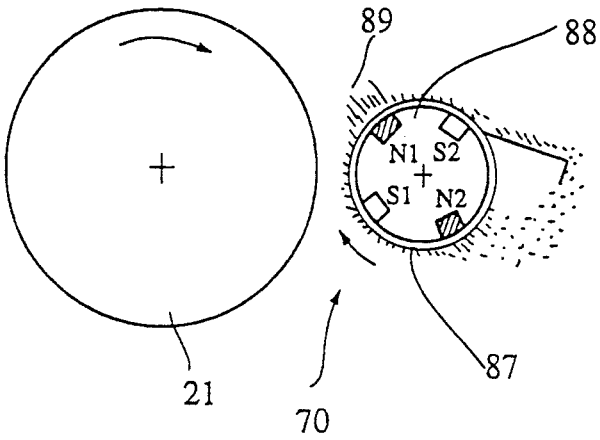
FIGS. 28(A) and (B) are partial schematic diagrams of the apparatus of FIG. 16 for explaining operation of toner supply control to be performed in this apparatus.
Figure 28:
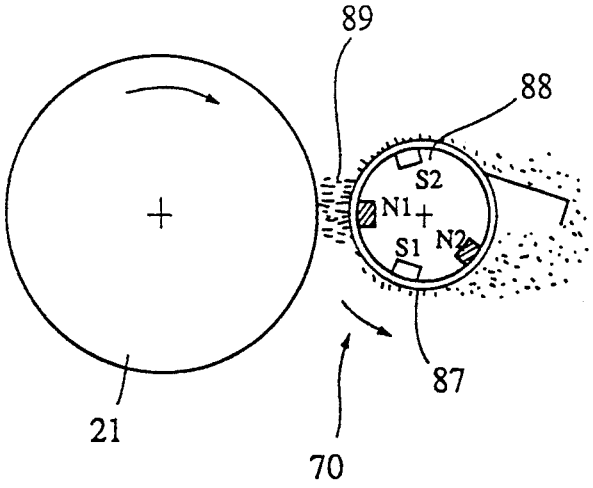

As shown in FIG. 28(A), the developing roller 70 has a hollow cylindrical sleeve 87 inside of which there is a magnet roller 88 carrying two pair of opposite magnetic poles N1, N2, and S1, S2, sleeve 87 and magnet roller 88 being separately rotatable. In suppressing the toner supply, developing roller 70 is controlled such that the magnetic pole N1, over which a pile of toner 89 is present, is located away from the photoconductive drum 21 so that the pile of toner 89 does not touch the photoconductive drum 21, even when the sleeve 87 is constantly rotated in a direction of the arrow in order to keep the toner charged.

On the other hand, as shown in FIG. 28(B), in providing the toner supply, this developing roller 70 is controlled such that the magnet roller 88 is rotated counter-clockwise till the magnetic pole N1, over which the pile of toner 89 is present, is located closest to the photoconductive drum 21, so that the pile of toner 89 touches the photoconductive drum 21, even when the sleeve 87 is constantly rotated in a direction of the arrow in order to keep the toner charged.

The timing relation for such toner supply suppression is as follows.

Figure 29:
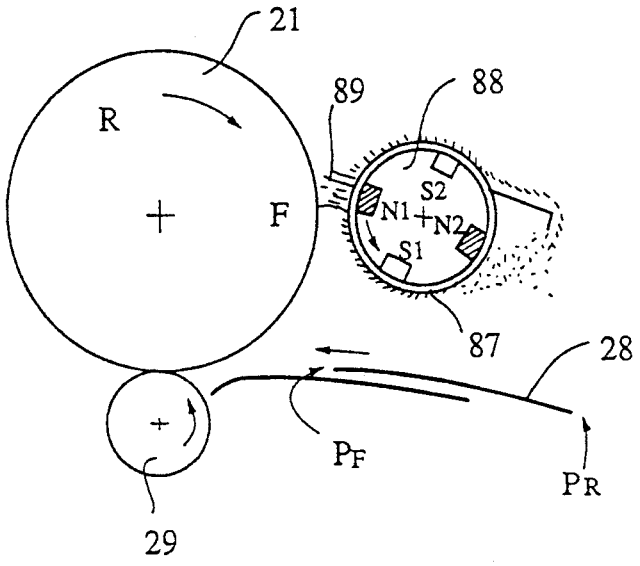
FIGS. 29(A) and (B) are partial schematic diagrams of the apparatus of FIG. 16 for explaining timings in the transfer operation in this apparatus.
Figure 29:
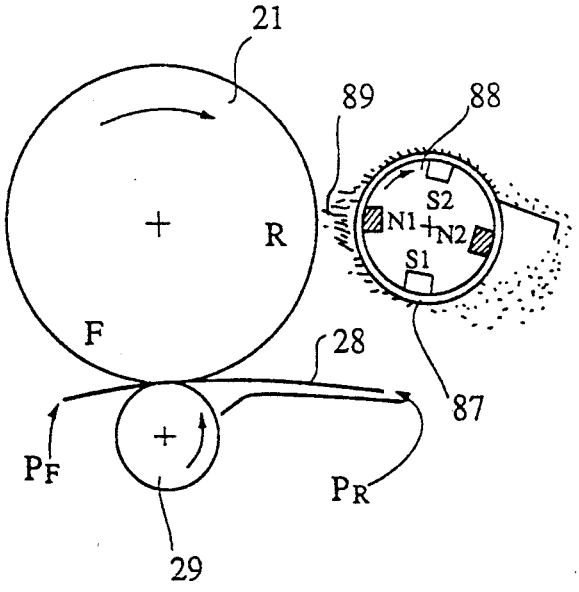

First, the magnet roller 88 is rotated counter-clockwise till the magnetic pole N1 carrying the pile of toner 89 is located closest to the photoconductive drum 21 so that the pile of toner 89 touches the photoconductive drum 21 at a point marked F, and as the photoconductive drum 21 rotates in clockwise direction, the point marked F meets the front edge $P_F$ of the receiving paper 28 between the photoconductive drum 21 and the transfer roller 29 to start transferring, as shown in FIG. 29(A).

Then, when the photoconductive drum 21 further rotates in clockwise direction so that the point marked R comes under the developing roller 70, the magnetic roller 88 is rotated clockwise till the magnetic pole N1 carrying the pile of toner 89 is located away from the photoconductive drum 21 so that the supply of the toner stops, as shown in FIG. 29(B). The point marked R on the photoconductive drum 21 eventually comes around to meet the rear edge $P_R$ of the receiving paper 28 between the photoconductive drum 21 and the transfer roller 29 to end transferring of the toner.

Figure 30:
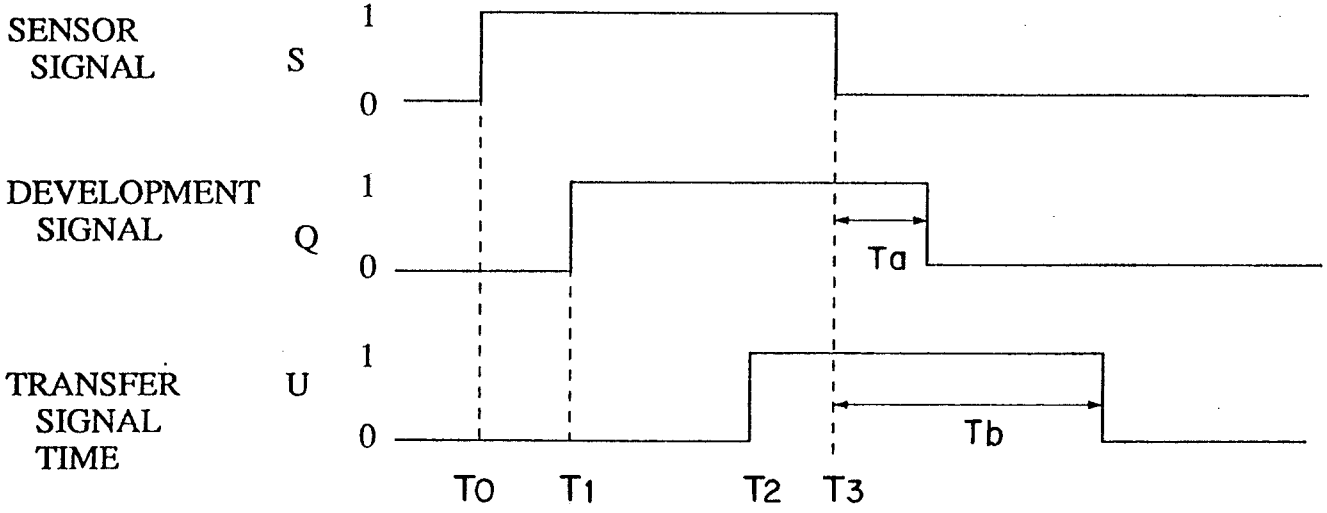
FIG. 30 is a timing chart for the transfer device control to be carries out by the apparatus of FIG. 16.

In this transfer process, the toner supply control by developing roller 70 as well as the transferring by the transfer roller 29 are controlled by the development signals Q, and the transfer signals U from the microcomputer 81, in accordance with the sensor signals S, in the timing sequence shown in FIG. 30, the on and off of the signals are represented in binary by a 1 and 0, respectively.

Namely, at time T0, the sensor 80 detects the passage of the front edge $P_F$ of the receiving paper 28 and produces sensor signals S to the microcomputer 81.

Then, the microcomputer 81 sends development signals Q to the toner supply control unit 82 at time T1, prescribed to be later than the time T0, to start the supply of toner from the developing roller 70 at point F.

Then, the microcomputer 81 sends transfer signals U to the transfer bias voltage source, not shown, at time T2 prescribed to be later than the time T1 to start applying the transfer bias voltage to the transfer roller 29 so as to start the transfer when the point F meets front edge $P_F$ of receiving paper 28.

When the sensor 80 detects the passage of the rear edge $P_R$ of the receiving paper 28 and the sensor signals S to the microcomputer 81 stops at time T3, the microcomputer 81 stops the development signals Q to the toner supply control unit 82 after a prescribed time delay Ta from the time T3 to stop the supply of toner from the developing roller 70 at the point marked R.

Finally, the microcomputer 81 stops the transfer signals U to the transfer bias voltage source after a prescribed time delay Tb from the time T3 to stop the transfer bias voltage application to the transfer roller 29 so as to end the transfer when the point marked R meets the rear edge $P_R$ of the receiving paper 28.

In determining the timing for the transfer bias voltage application, the following considerations apply.

In principle, the transfer bias voltage application starts when the front edge $P_F$ of the receiving paper 28 comes to the contact point between the photoconductive drum 21 and the transfer roller 29, and ends when the rear edge $P_R$ of the receiving paper 28 reaches the contact point between the photoconductive drum 21 and the transfer roller 29. This prevents an accidental printing such as that due to the drifting toner, and moreover reduces the chance of accidentally damaging the photoconductive drum 21 caused by applying the transfer bias voltage without the receiving paper 28 between the photoconductive drum 21 and the transfer roller 29.

Figure 31:
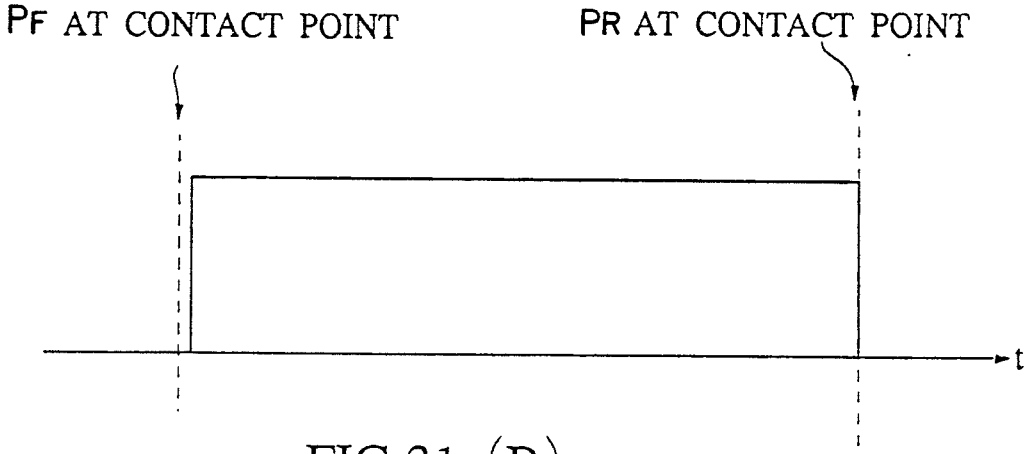
FIGS. 31(A), (B), and (C) are timing charts for the transfer bias voltage control to be carries out by the apparatus of FIG. 16.
Figure 31:
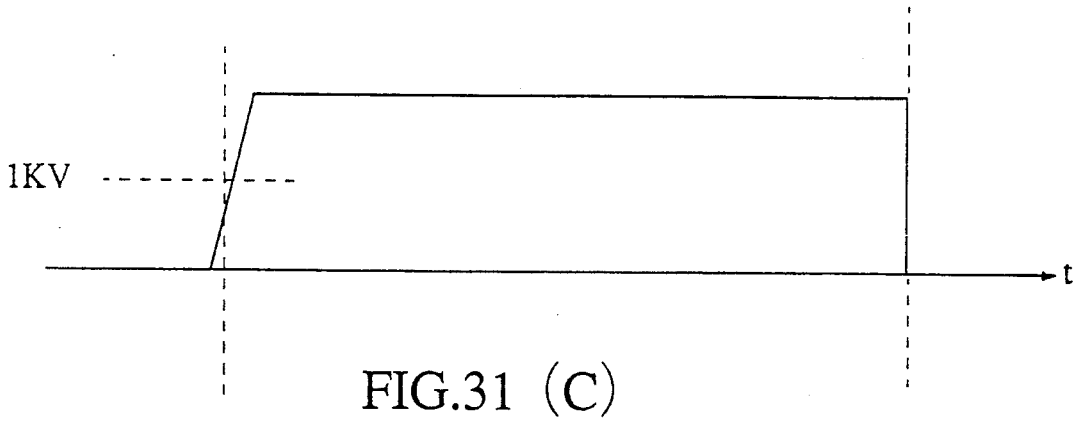
Figure 31:
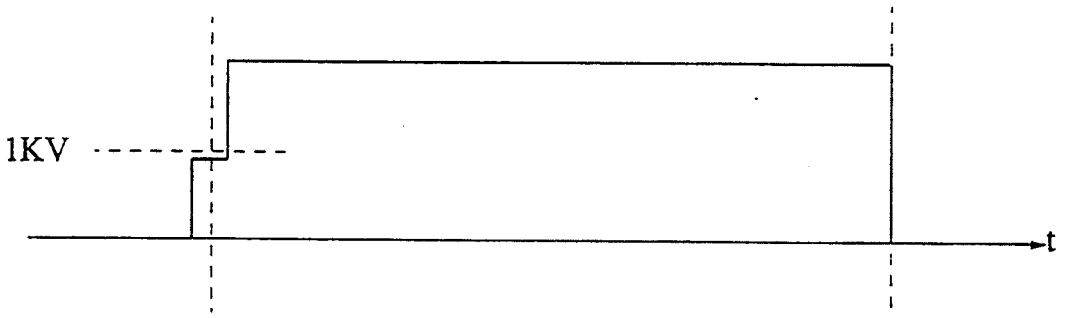

However, when this application of the transfer bias voltage is carries out in an exact or premature timing, there might be a jamming of the receiving paper 28 which rolls around the photoconductive drum 21. For this reason, it is preferable to start applying the transfer bias voltage after the front edge $P_F$ of the receiving paper 28 moved some distance such as 1 mm from the contact point between the photoconductive drum 21 and the transfer roller 29, as shown in FIG. 31(A).

Alternatively, the application of the transfer bias voltage may start earlier with reduced voltage at which the jamming is less frequent. Two examples of such transfer bias voltage are shown in FIG. 31(B) in which the transfer bias voltage is gradually increased, and in FIG. 31(C) in which the transfer bias voltage is increased step-wise. In both cases, the care has been taken to keep the transfer bias voltage less than 1 kV, beyond which the jamming becomes serious concern. With this smaller transfer bias voltage, the toner transfer efficiency is reduced to below 50%, but no practical trouble arises since very often there is no image near the front edge $P_F$.

Similarly, when stopping the application of the transfer bias voltage, it is in principle best to do so exactly when the rear edge $P_R$ of the receiving paper 28 reaches the contact point between the photoconductive drum 21 and the transfer roller 29, but slightly earlier turning off may also be acceptable.

One variation of the toner supply suppression described above is shown in FIGS. 32(A), (B), and (C).

Figure 32:
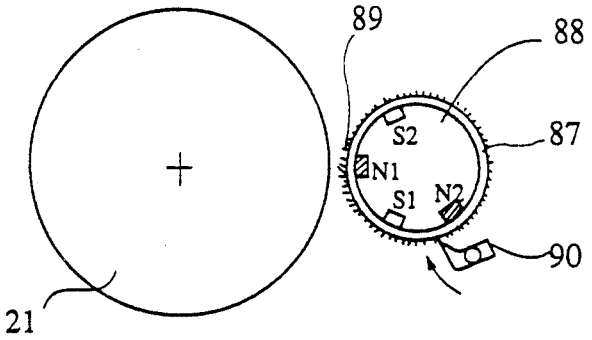
FIGS. 32(A), (B), and (C) are partial schematic diagrams of one variation of the apparatus of FIG. 16 for explaining the manner to reduce the excess toner in this apparatus.
Figure 32:
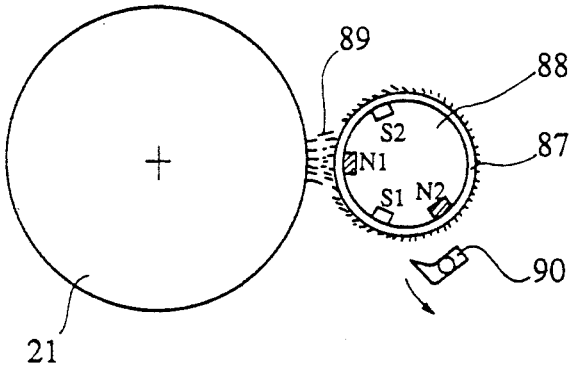
Figure 32:
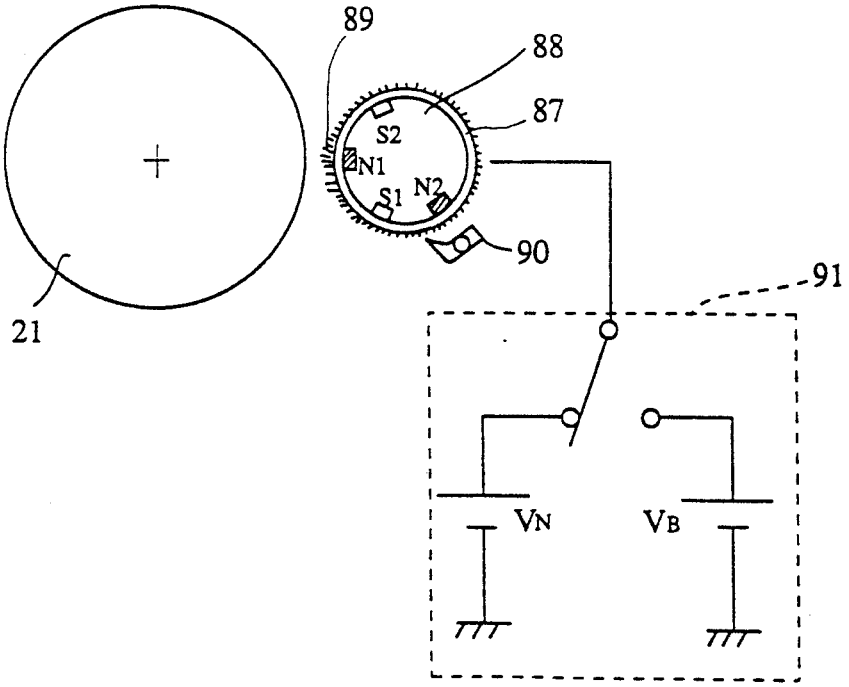

Here, instead of controlling the movement of the magnet roller 88, a leveling blade 90 for adjusting thickness of the toner on the developing roller is provided around the sleeve 87, whose movement with respect to the sleeve 87 is controlled such that in suppressing the toner supply the leveling blade 90 is brought closer to the sleeve 87 so as to level down the pile of toner 89 on the sleeve 87 as shown in FIG. 32(A), whereas in providing the toner supply the leveling blade 90 is moved away from the sleeve 87 so as to allow the pile of toner 89 to approach the photoconductive drum 21, as shown in FIG. 32(B).

FIG. 32(C) shows a further improvement of this variation accomplished by providing a developing bias controller 91 connected to the sleeve 87. In this case, in addition to the movement of the leveling blade 90 as described above, the developing bias controller 91 is also controlled such that in suppressing the toner supply the suppressing voltage $V_N$ nearly equals the potential level of the surface of the photoconductive drum 21 applied to the sleeve 87 in order to ensure that the toner supply is suppressed, whereas in providing the toner supply the supplying voltage $V_B$ much lower than the suppressing voltage $V_N$ is applied to the sleeve 87.

As a similar improvement, a whole sleeve 87 or even the developing device itself may be made to move away from the photoconductive drum 21 in suppressing the toner supply, if desired.

Figure 33:
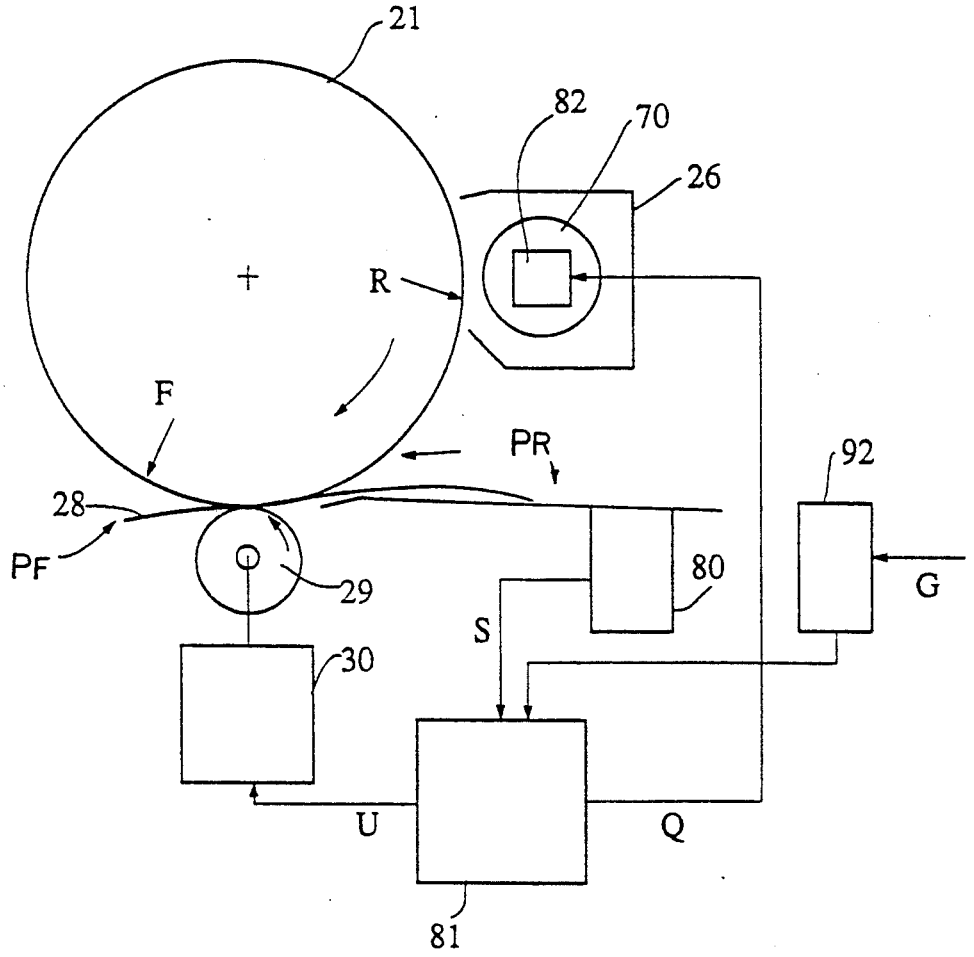
FIG. 33 is a schematic diagram of another variation of the apparatus of FIG. 16.

One variation of the electrophotographic printing apparatus of FIG. 26 is shown in FIGS. 33, which is particularly suitable for a laser printer.

Here, in addition to the sensor 80, there is provided an image detecting unit 92 which is fed with the data on the letters and images to be printed and provides the information on the front and rear ends of the letters and images to be printed. With this additional information the microcomputer 81 can perform even more efficient controlling of the toner supply from the developing roller 70 and the transfer bias voltage application from the transfer bias voltage source 30, taking account of distribution of the actual letters and images to be printed, rather than just the receiving paper size.

Such a toner supply control, just described, can reduce the amount of residual toner on the photoconductive drum 21 to less than a half, and that on the transfer roller 29 to less than a fifth. This latter reduction is so great that only service personnel in regular periodic inspections need to discard the accumulated toner, relieving the user from any maintenance effort in this regard. It also reduces the contamination of the transfer roller 29.

It is to be noted that the application of the toner supply control just described is not necessarily limited to the other features of the electrophotographic printing apparatus described earlier, and can be beneficially applied to other systems such as those using one-component magnetic toner, one-component non-magnetic toner, or those utilizing a corona charger instead of the transfer roller.

Now, in the above description of the electrophotographic printing apparatus of FIG. 16, the residual toner 32 on the photoconductive drum 21 is cleaned by the cleaning device 33 before the next printing process. However, by using the transfer roller 29 according to the present invention, this cleaning of the residual toner 32 can also be accomplished without the cleaning device 33, as in the following.

Figure 34:
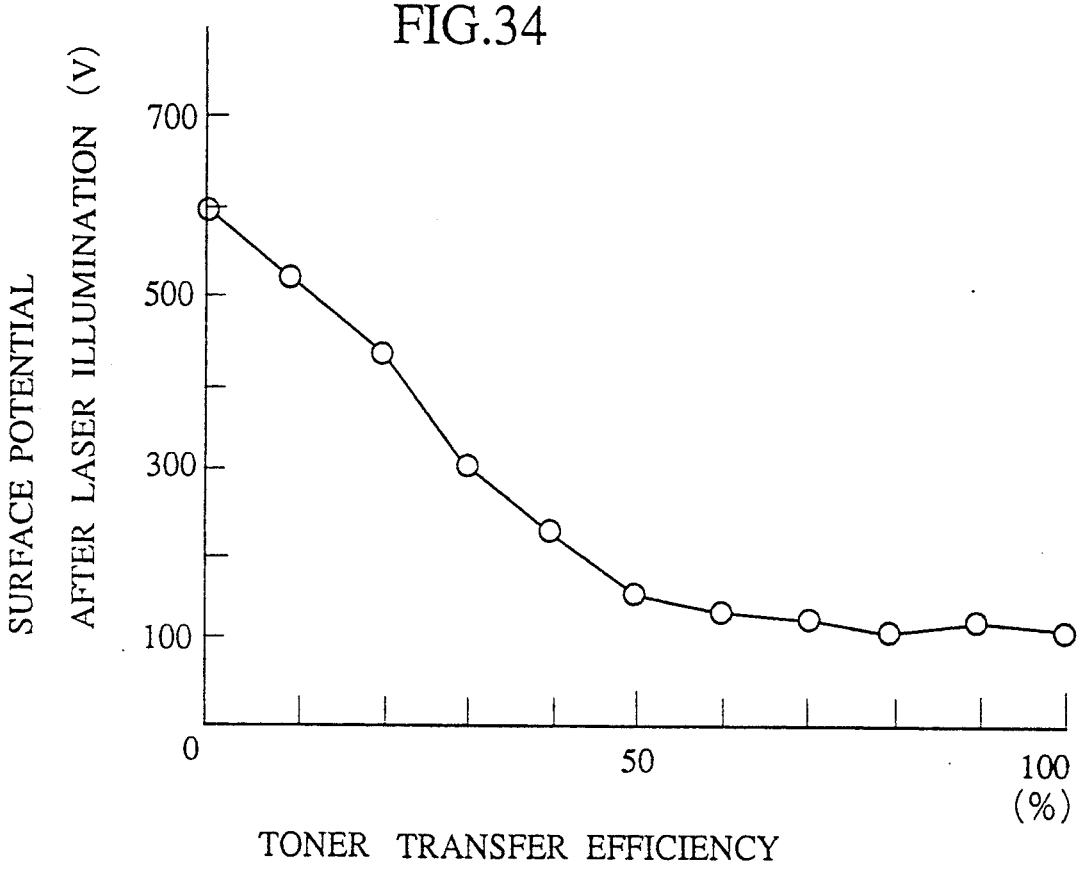
FIG. 34 is a graph of the transfer efficiency versus the potential level of the surface of the photoconductive drum after the laser illumination, for the apparatus of FIG. 16.

As already explained in the descriptions of various embodiments of the transfer roller, the use of these soft transfer roller according to the present invention can reduce the amount of the residual toner drastically, even in a highly humid environment. As a result, when the photoconductive drum 21 is illuminated by the deletion lamp 34 for cleaning out the negative charges 23 on the photoconductive drum 21, the illumination light from the deletion lamp 34 can reach the surface of the photoconductive drum 21 regardless of the presence of the residual toner 32 on the surface of the photoconductive drum 21, as the residual toner 32 is very thin even if present. Consequently, the negative charge 23 on the photoconductive drum 21 can almost completely be eliminated by this illumination from the deletion lamp. Likewise, when the photoconductive drum 21 is charged by the charger 22 in the following printing process, the photoconductive drum 21 can almost completely uniformly be charged, regardless of the presence of residual toner 32 the photoconductive drum 21 is subsequently illuminated by the light signal 24 for the electrostatic latent image formation, a complete electrostatic latent image can be formed, as the light signal 24 can penetrate through the thin residual toner even if it existed. This fact is evidenced in FIG. 34 which shows the relationship between the transfer efficiency and the potential level of the surface of the photoconductive drum 21 after laser illumination. As shown in FIG. 34, the discharging of the negative charge 23 performed in the electrostatic latent image formation by the light signal 24 can effectively done for the higher efficiency which is consistently obtainable by the use of the transfer roller according to the present invention.

Because of this fact, the removal of the residual toner 32 before the charging by the charger 22 and the illumination by the light signal 24 for the next printing process is not essential in the electrophotographic printing apparatus using the transfer roller 29 according to the present invention. In fact, the developing device 26 can be utilized for the effective removal of the unnecessary toner as follows.

When the photoconductive drum 21 with the electrostatic latent image formed by the light signal 24 and the residual toner 32 from the previous printing comes around to the developing device 26, the residual toner 32 not illuminated by the light signal 24 to discharge the negative charge 23 underneath, i.e., not on a part of the new electrostatic latent image, have the potential lower than that of the developing roller 70 biased by the bias voltage source 25 so that these residual toner will be attracted to the developing roller and thereby removed from the photoconductive drum 21. On the other hand, the residual toner 32 illuminated by the light signal 24 to discharge the negative charge 23 underneath, i.e., those on a part of the new electrostatic latent image, have a potential higher than or equal to the developing roller, so that these residual toner will remain on the photoconductive drum 21, but since these portion of the photoconductive drum 21 is to be supplied with the toner from the developing device 33 anyway, so that the continuing presence of the residual toner, there is no problem.

In this manner, only those residual toner 32 which is not going to be a part of the new electrostatic latent image will be effectively removed by the developing device 33, so that undesirable phenomena, such as fog due to the residual toner, can be prevented, without the use of the cleaning device 33 for cleaning the residual toner 32.

Figure 35:
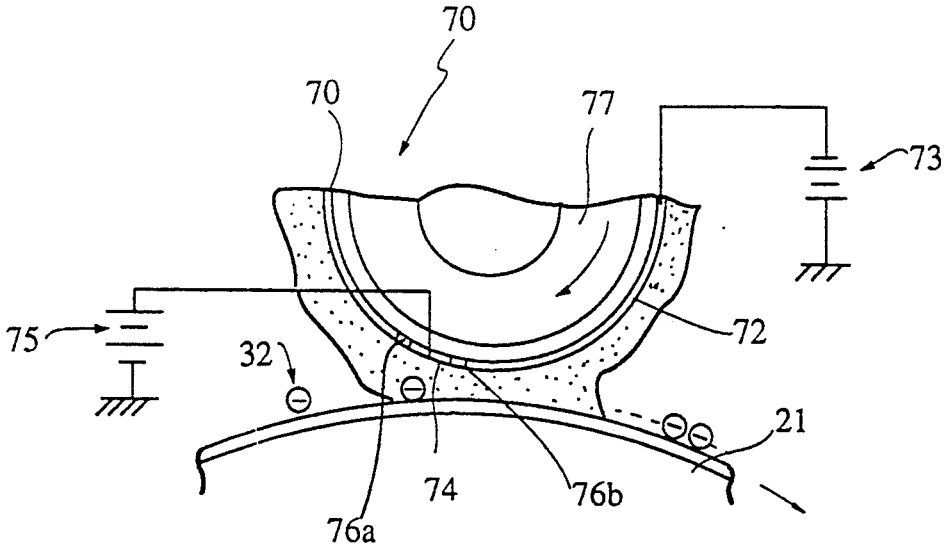
FIG. 35 is a cross sectional view of one embodiment of the developing roller to be used in the apparatus of FIG. 21.

One suitable configuration of the developing roller of the developing device 33 will now be described with reference to FIG. 35.

This developing roller 70 has a sleeve 71 which includes a negative section 72 connected to the negative developing bias voltage source 73 and a positive section 74 connected to the positive developing bias voltage source 75, which are separated by insulators **76*a* and 76*a*. Inside this sleeve 71, there is provided a magnet roller 77 which can rotate with respect to the sleeve 71 in a direction opposite to that of the photoconductive drum 21 as indicated by arrows. The rotation of this magnet roller 77 with respect to the sleeve 71 causes magnetic toner 49 to move along the sleeve 71. The thickness of such magnetic toner 49 on the sleeve 71 is controlled by a blade (not shown) which is located around the developing roller 70 in such a position as to perform this controlling of the thickness of the magnetic toner 49 on the sleeve 71 before the magnetic toner 49 is brought into contact with the photoconductive drum 21. This same blade is also responsible for negatively charging the magnetic toner 49. Now, when the residual toner 32 comes around to the positive section 74 of the developing roller 70, the negatively charged residual toner 32 will be attracted to the positive section 74 and be carried away from the photoconducted drum 21 with the other magnetic toner 49 moving along the sleeve 71 so that it can be used as a supply again. On the other hand, when the electrostatic latent image portion comes around to the negative section 72 of the developing roller 70 the negatively charged magnetic toner 49** will be attached on the electrostatic latent image portion electrostatically to form the visible image.

Thus, both the cleaning of the residual toner from the previous printing and the developing of the new electrostatic latent image can be handled by one and the same developing roller 70 in this embodiment.

Although in the last embodiment of the developing roller 70 the residual toner 32 is returned to the toner supply, when the cleaning device 33 described earlier is to be used, the residual toner 32 is collected and this must be discarded later by a user. Also, the toner attached on the transfer roller 29 cleaned by the transfer roller cleaning blade 40 is collected and this too must be discarded later by the user.

Besides those already mentioned, many modifications and variations of the above embodiments may be made without departing from the novel and advantageous features of the present invention. Accordingly, all such modifications and variations are intended to be included within the scope of the appended claims.

What is claimed is:

1. A transfer device for an electrophotographic printing apparatus, in which a toner image formed by toner is to be transferred onto a receiving paper, comprising:

photoconductive drum means for carrying the toner image formed in accordance with an electrostatic latent image formed thereon;

transfer roller means which makes contact with the photoconductive drum means for effectuating the transfer of the toner image onto the receiving paper, the receiving paper being conveyed between the transfer roller means and the photoconductive drum means, the transfer roller means including:

an outermost resistive layer which makes contact with the receiving paper;

a flexible conductive layer inside the outermost resistive layer and which is electrically connected to the resistive layer;

an elastically deformable elastic sponge rubber layer inside the conductive layer;

a metallic shaft inside the elastic sponge rubber layer to which a transfer bias voltage is applied;

an elastically deformable elastic conductive portion electrically connecting the metallic shaft and the conductive layer; and transfer bias voltage source means for applying the transfer bias voltage which causes the transfer of the toner image, to the transfer roller means.

2. The device of claim 1, wherein the resistive layer has a resistivity per unit area in a range of $1\times10^{7}$–$1\times10^{10}$ $\Omega\cdot cm^2$.

3. The device of claim 2, wherein the resistive layer has the resistivity per unit area in a range of $1\times10^{8}$–$5\times10^{8}$ $\Omega\cdot cm^2$.

4. The device of claim 2, wherein the conductive layer has a volume resistivity of less than $10^6$ $\Omega\cdot cm$.

5. The device of claim 4, wherein the conductive layer has the volume of resistivity less than $10^5$ $\Omega\cdot cm$.

6. The device of claim 1, wherein the elastic sponge rubber layer has a thickness not less than ten times a sum of thicknesses of the resistive layer and the conductive layer.

7. The device of claim 1, wherein the elastic sponge rubber layer has a thickness more than 2 mm.

8. The device of claim 1, wherein the elastic sponge rubber layer has a hardness less than that corresponding to 30 degree for Japanese Industrial Standard, and wherein the transfer roller means makes contact with the photoconductive drum means with a pressure in a range of 20–300 $g/cm^2$.

9. The device of claim 8, wherein the transfer roller means makes contact with the photoconductive drum means with a pressure in a range of 100–200 $g/cm^2$.

10. The device of claim 1, wherein the resistive layer has a resin sheet structure.

11. The device of claim 1, wherein the elastic sponge rubber layer has a continuous foam structure.

12. The device of claim 1, wherein the transfer roller means further comprises a conductive rubber layer between the conductive layer and the elastic sponge rubber layer.

13. The device of claim 1, wherein a surface of the transfer roller means has no concavity deeper than 12 $\mu m$ depth.

14. The device of claim 13, wherein a surface of the transfer roller means has no concavity deeper than 5 $\mu m$ depth.

15. The device of claim 1, wherein a surface of the transfer roller means has no waving deeper than 20 $\mu m$ depth.

16. The device of claim 1, wherein the transfer roller means further includes extended member having a resistivity not less than that of the resistive layer, extending in a direction along axis of rotation of the transfer roller means, to be longer in this direction than the conductive layer.

17. The device of claim 16, wherein the extended member is longer in the direction along axis of rotation of the transfer roller means than the conductive layer by a length in a range of 0.5–5 mm at both ends.

18. The device of claim 1, wherein the resistive layer has a resistivity which decreases as atmospheric vapor pressure increases.

19. The device of claim 18, wherein the resistivity of the resistive layer times a thickness of the resistive layer takes a value in a range of $1\times10^{7}$–$1\times10^{9}$ $\Omega\cdot cm^2$ when the atmospheric vapor pressure is in a range of 10–40 mb.

20. The device of claim 18, wherein the resistive layer is made of vinylidene fluoride.

21. The device of claim 1, further comprising incompressible and insulative guiding ring means having contact with the photoconductive drum means and to be attached on sides of the transfer roller means, for intermediating rotational motion of the photoconductive drum means to the transfer roller means, the guide ring means having radius less than that of the transfer roller means.

22. The device of claim 21, wherein the radius of the guide ring means is less than that of the transfer roller means by no more than 300 $\mu m$.

23. The device of claim 22, wherein the radius of the guide ring means is less than that of the transfer roller means by no more than 150 μm.

24. The device of claim 1, wherein the transfer bias voltage source means applies the transfer bias voltage in pulsed form.

25. The device of claim 24, wherein the pulsed form transfer bias voltage has a pulse width in a range between 0.2 sec and 4 μsec.

26. The device of claim 25, wherein the pulsed form transfer bias voltage has a pulse width in a range between 20 msec and 1 msec.

27. The device of claim 24, wherein the pulsed form transfer bias voltage pulsates at least twice during a time in which a point on the receiving paper passes through the contact area between the transfer roller means and the photoconductive drum means.

28. The device of claim 24, wherein the transfer bias voltage source means is equipped with a variable resistor protection against current overflow.

29. The device of claim 24, wherein the pulsed form transfer bias voltage is obtained as an AC voltage biased by a DC voltage.

30. The device of claim 1, further comprising:

control charger means located around the transfer roller means for charging up the toner on the transfer roller means; and cleaning device located around the photoconductive drum means for removing the toner on the photoconductive drum means after the transferring; and wherein the transferring is followed by a roller cleaning in which toner on the transfer roller means is charged up by the control charger means, and then the transfer bias voltage is applied by the transfer bias voltage source means.

31. The device of claim 1, further comprising:

main charger means for charging up the photoconductive drum means;

control charger means located around the transfer roller means for charging up the toner on the transfer roller means; and cleaning device located around the photoconductive drum means for removing the toner on the photoconductive drum means after the transferring; and wherein the transferring is followed by a roller cleaning in which toner on the transfer roller means is charged up by the control charger means, and the photoconductive drum means is charged up by the main charger means such that the potential level of the photoconductive drum means is lower than that of the transfer roller means.

32. The device of claim 1, further comprising transfer roller cleaning blade means making contact with surface of the transfer roller means, for cleaning the toner on the transfer roller means, the blade means having a pivot positioned in a region closer to the transfer roller means with respect to a tangent line of the surface of the transfer roller means at location where the blade means makes contact with the transfer roller means.

33. The device of claim 32, wherein the pivot of the blade means is located ahead in a direction of rotation of the transfer roller means, with respect to the location where the blade means makes contact with the transfer roller means.

34. The device of claim 32, wherein the blade means having a supporting member which is not straight, and wherein the blade means is given a pressure against the transfer roller means externally.

35. The device of claim 32, wherein a line pressure between the transfer roller means and the blade means is less than that between the transfer roller means and the photoconductive drum means by no less than 5 g/cm.

36. The device of claim 32, wherein a line pressure between the transfer roller means and the blade means is in a range of 10–35 g/cm.

37. The device of claim 1, further comprising:

developing means for supplying toner to the electrostatic latent image on the photoconductive drum means;

sensor means for detecting area to be given the toner from the developing means; and toner control means for controlling the developing means such that toner is supplied only to those area detected by the sensor means.

38. The device of claim 37, further comprising transfer control means for controlling the transfer bias voltage source means such that the transfer bias voltage is applied only when the area with the toner given comes to the transfer roller means.

39. The device of claim 38, wherein the control by the transfer control means is such that the transfer bias voltage application begins after a front edge of the receiving paper moved a prescribed distance from a contact point between the transfer roller means and the photoconductive drum means.

40. The device of claim 38, wherein the control by the transfer control means is such that the transfer bias voltage is increased from zero before a front edge of the receiving paper reaches a contact point between the transfer roller means and the photoconductive drum means to a non-zero value after the front edge of the receiving paper moved a prescribed distance from the contact point between the transfer roller means and the photoconductive drum means.

41. The device of claim 37, wherein the developing means includes rotatable magnet roller means for making localized pile of the toner, and wherein the toner control means controls the magnet roller means such that a distance between the localized pile of the toner and the photoconductive drum means is changed.

42. The device of claim 37, wherein the developing means includes sleeve from which the toner is supplied and leveling blade means located around the sleeve for limiting amount of the toner on the sleeve, and wherein the toner control means controls the leveling blade means such that the amount of the toner on the sleeve is changed.

43. The device of claim 42, wherein the developing means further includes selective bias voltage means for applying selected bias voltage to the sleeve, and wherein toner control means also controls the selective bias voltage means such that the potential level of the sleeve is changed.

44. The device of claim 1, further comprising:

developing means for supplying toner to the electrostatic latent image on the photoconductive drum means; and bias voltage means for giving bias voltage to the developing means such that the residual toner left on the photoconductive drum means from previous printing which is not on new electrostatic latent image formed on the photoconductive drum means is attracted toward the developing means.

45. The device of claim 44, wherein the developing means includes a developing roller having a positive sleeve portion and a negative portion, and wherein the bias voltage means includes a positive bias voltage source connected to the positive sleeve portion and a negative bias voltage source connected to the negative sleeve portion.

46. A transfer device for an electrophotographic printing apparatus, in which a toner image formed by a toner is to be transferred onto a receiving paper, comprising:

photoconductive drum means for carrying the toner image formed in accordance with an electrostatic latent image formed thereon;

transfer roller means which makes contact with the photoconductive drum means for effectuating the transfer of the toner image onto the receiving paper, the receiving paper being conveyed between the transfer roller means and the photoconductive drum means;

transfer bias voltage source means for applying a transfer bias voltage which causes the transfer of the toner image, to the transfer roller means;

developing means for supplying toner to the electrostatic latent image on the photoconductive drum means;

sensor means for detecting an area on the photoconductive drum means to be given toner from the developing means; and toner control means for controlling the developing means such that toner is supplied only to those area detected by the sensor means.

47. The device of claim 46, further comprising transfer control means for controlling the transfer bias voltage source means such that the transfer bias voltage is applied only when the area with toner given comes to the transfer roller means.

48. The device of claim 47, wherein the control by the transfer control means is such that the transfer bias voltage application begins after a front edge of the receiving paper moved a prescribed distance from a contact point between the transfer roller means and the photoconductive drum means.

49. The device of claim 47, wherein the control by the transfer control means is such that the transfer bias voltage is increased from zero before a front edge of the receiving paper reaches a contact point between the transfer roller means and the photoconductive drum means to a non-zero value after the front edge of the receiving paper moved a prescribed distance from the contact point between the transfer roller means and the photoconductive drum means.

50. The device of claim 46, wherein the developing means includes rotatable magnet roller means for making localized pile of the toner, and wherein the toner control means controls the magnet roller means such that a distance between the localized pile of the toner and the photoconductive drum means is changed.

51. The device of claim 46, wherein the developing means includes sleeve from which the toner is supplied and leveling blade means located around the sleeve for limiting amount of the toner on the sleeve, and wherein the toner control means controls the leveling blade means such that the amount of the toner on the sleeve is changed.

52. The device of claim 51, wherein the developing means further includes selective bias voltage means for applying selected bias voltage to the sleeve, and wherein toner control means also controls the selective bias voltage means such that the potential level of the sleeve is changed.

53. A method of toner image transfer for an electrophotographic printing apparatus, in which a toner image formed by a toner is transferred onto a receiving paper, comprising the steps of:

forming an electrostatic latent image on a photoconductive drum;

detecting an area on the photoconductive drum to which the toner is to be given from a developing means including a sleeve for supplying the toner to the photoconductive drum;

developing the detected area by the toner to obtain the toner image, while controlling leveling blade means located around the sleeve for limiting an amount of the toner on the sleeve such that an amount of the toner supplied from the sleeve is changed; and transferring the toner image onto the receiving paper by conveying the receiving paper to a transfer area, and by applying a transfer bias voltage.

54. The method of claim 53, wherein at the transferring step the transfer bias voltage is applied only when the area with toner given comes to the transfer area.

55. The method of claim 54, wherein at the transferring step the transfer bias voltage application begins after a front edge of the receiving paper moved a prescribed distance from the transfer area.

56. The method of claim 54, wherein at the transferring step the transfer bias voltage is increased from zero before a front edge of the receiving paper reaches the transfer area to a non-zero value after the front edge of the receiving paper moved a prescribed distance from the transfer area.

57. The method of claim 53, wherein at the developing step, rotatable magnet roller means for making localized pile of the toner is controlled such that a distance between the localized pile of the toner and the photoconductive drum is changed.

58. The method of claim 53, wherein at the developing step, selective bias voltage means for applying selected bias voltage to the sleeve is controlled such that the potential level of the sleeve is changed.

* * * * *